United States Patent [19]

Ando et al.

[11] Patent Number: 4,549,835

[45] Date of Patent: Oct. 29, 1985

[54] DOCKING APPARATUS FOR SHIPS

[75] Inventors: Takehiro Ando, Ibaraki; Shuji Miyake, Nara; Osamu Murakami, Honmachi; Takashi Kawabata, Osaka; Shigeo Hayashi, Habikino; Michiyasu Otonari, Osaka; Toyoaki Kato, Yamato, all of Japan

[73] Assignee: Hitachi Zosen Corporation, Osaka, Japan

[21] Appl. No.: 554,501

[22] Filed: Nov. 23, 1983

[51] Int. Cl.[4] ..... B63C 1/08

[52] U.S. Cl. ..... 405/4; 114/45; 114/222; 114/259; 405/1

[58] Field of Search ..... 405/1-7; 114/259, 260, 222, 44, 45, 48, 51

[56] References Cited

U.S. PATENT DOCUMENTS

| | | | |
|---|---|---|---|
| 1,079,901 | 11/1913 | Durand | 405/1 |
| 2,357,494 | 9/1944 | Basile | 405/2 |
| 2,550,823 | 1/1951 | King | 405/4 X |
| 3,332,248 | 7/1967 | Burnett | 114/44 X |
| 3,536,023 | 10/1970 | Toher et al. | 114/259 |
| 3,823,681 | 7/1974 | Cushing et al. | 114/260 |
| 4,077,350 | 3/1978 | Nishino et al. | 114/260 |
| 4,409,920 | 10/1983 | Hammelmann | 114/222 |

FOREIGN PATENT DOCUMENTS

| | | | |
|---|---|---|---|
| 0164588 | 12/1980 | Japan | 114/44 |

*Primary Examiner*—Dennis L. Taylor

*Attorney, Agent, or Firm*—Armstrong, Nikaido, Marmelstein & Kubovcik

[57] ABSTRACT

A docking apparatus comprises a drive truck adapted to run along a side wall of a dock approximately horizontally, a surface treating truck connected to the drive truck at all times and having a hull surface treating device, and a docking truck connectable to and separable from the drive truck and having a retractable hull suction disk. The drive truck only is provided with drive units for running.

9 Claims, 58 Drawing Figures

180
176
171
182
172
191
204
165
62
4
242
243
248
183
254
245
166
251
255
63
33
22
69
215
7
207
210
8
11
36
50
27
27
48
247
2
6
260
90
241
271
270
269
246
262
266
264

180
176
171
182
172
204
191
62
165
4
223
183
63
166
224
229
215
69
22
33
210
207
7
226
50
36
11
27
8
27
48
6
228
2
232
90
233
222
227
238
240
268
267
240
239
261
265
263

180
176
183
171
172
191
204
165
242
243
248
245
251
166
255
254
215
27
22
27
207
210
7
8
11
247
2
6
90
260
270
271
241
246
269
262
266
264

180
176
183
171
172
191
204
165
223
166
224
229
207
215
27
22
27
210
7
11
8
226
6
228
2
90
232
233
227
238
240
268
267
240
239
222
261
265
263

223
6
224
214
215
4
229
A
207
220
213
B
207
S46
S46
208
216
213
69
213
211
C
209
210
218
221
212
213
207
207
48
50
226
228
90

DOCKING APPARATUS FOR SHIPS

TECHNICAL FIELD

The present invention relates to an apparatus for hauling ships into and out of docks.

BACKGROUND ART

When ships are hauled into docks for repairing, the surface of the hull is cleaned with pressurized water first to remove salt and deposits, then blasted at corroded portions and finally coated with paint. After these hull surface treating procedures have been completed in series, the ship is hauled out of the dock. The operation of hauling the ship into and out of the dock and the surface treating operation are the chief work at the dock, which must therefore be equipped with apparatus for performing these operations. Self-running surface treating trucks provided on opposite side walls of the dock are usually used for the surface treating operation, while ships are hauled into and out of the dock usually by a rope. With such a tow apparatus, however, the rope must be tied to and removed from the ship for docking manually by many workers, so that the work temporarily reaches a peak and involves problems in respect of safety. Furthermore, docks of larger scale receive larger ships which require a rope of increased diameter to result in a higher peak in the amount of work. To meet the situation, it appears useful to provide on opposite side walls of the dock self-running docking trucks for hauling the ship into and out of the dock. However, since the surface treating operation and the hauling operation are conducted not concurrently but, so to speak, alternatively, it is uneconomical to provide two types of self-running trucks separately, while there is the likelihood that one truck will become an obstacle when the other truck is used. Although it may be possible to use a single truck for both surface treatment and docking, the truck, which needs to have a great weight for hauling the ship into and out of the dock, must be driven in its entirety also for surface treatment. Generally the truck is run more frequently for surface treatment than for hauling, so that the travel of the heavey truck in its entirety for surface treatment entails an increased operating cost and is not economical.

DISCLOSURE OF THE INVENTION

An object of the present invention is to overcome the foregoing problems and to provide an economical docking apparatus for ships which assures savings in labor and improved safety when hauling the ship into and out of a dock.

The present invention provides an apparatus for hauling a ship into and out of a dock comprising a drive truck adapted to run along a side wall of the dock approximately horizontally, a surface treating truck connected to the drive truck at all times and having a hull surface treating device, and a docking truck connectable to and separable from the drive truck and having a retractable hull suction disk, the drive truck alone being provided with running drive means.

When a ship is to be hauled into or out of the dock by the present apparatus, the docking truck is connected to the drive truck, the suction disk of the docking truck is brought into sucking engagement with the hull, and the three trucks are caused to run by the running drive unit on the drive truck to pull the ship along. Thus there is no need to use a tow wire rope conventionally used.

For surface treatment, the docking truck is separated from the drive truck and held at rest at a suitable location, e.g., at the inlet or innermost portion of the dock, allowing the drive truck and the surface treating truck only to run.

The ship can be hauled into or out of the dock by the present apparatus, with the docking truck connected to the drive truck, without using any tow wire rope. This operation can be carried out also automatically. Accordingly the present apparatus does not require many workers, assuring savings in labor and improved safety in the hauling operation. Because the drive truck and the surface treating truck only can be run for surface treatment with the docking truck separated from the drive truck, the treating truck is operable inexpensively for frequent use, hence economical. The present apparatus is also economical in that the running drive means is mounted on the drive truck only but not on the surface treating truck or the docking truck. While the surface treating truck is generally provided with a jib which is swivellable and movable to an upwardly inclined position and a support attached to the forward end of the jib for supporting hull surface treating devices, the elongated jib, the support, etc. are supportable with good stability by the two trucks, i.e., the drive truck and the surface treating truck which is connected thereto at all times.

DETAILED DESCRIPTION OF EMBODIMENT

Figure 1A:
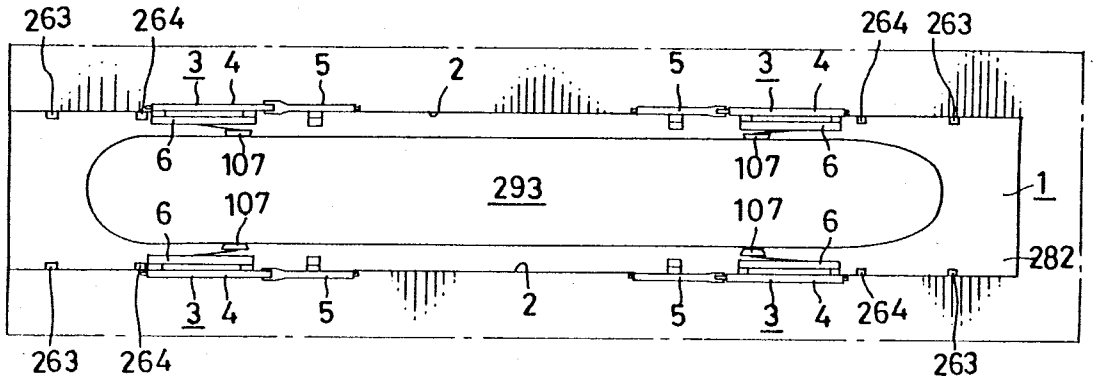
FIGS. 1 (*a*) and (*b*) are plan views of a dock and docking apparatus of the invention to schematically show the apparatus in two modes, i.e., in docking operation and hull surface treating operation.
Figure 1B:
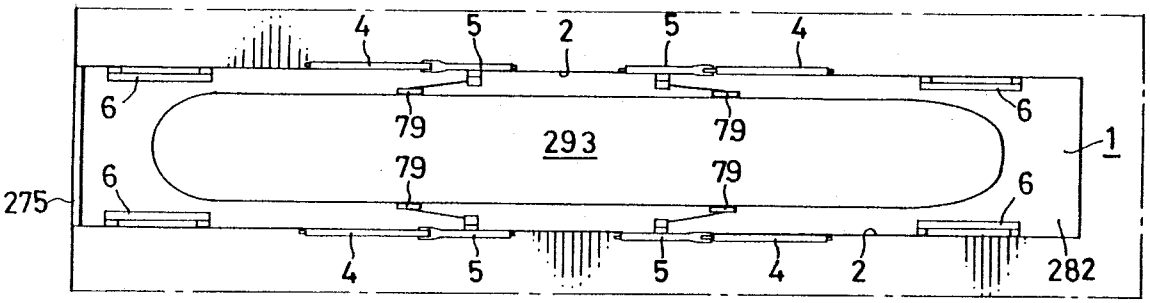

With reference to FIG. 1, two docking apparatus 3 are provided on each of opposite side walls 2 of a dock 1. Each docking apparatus 3 comprises a drive truck 4, a surface treating truck 5 connected thereto at all times, and a docking truck 6 connectable to and separable from the drive truck 4. The docking apparatus 3 positioned toward the innermost portion of the dock on one side wall 2 is shown in detail in FIGS. 2 to 50.

With reference to FIGS. 2 to 10, horizontally extending upper track 8 and lower track 9 are respectively mounted on a horizontal stepped portion 7 at an upper portion of the dock side wall 2 and on a lower portion of the side wall 2.

Figure 11:
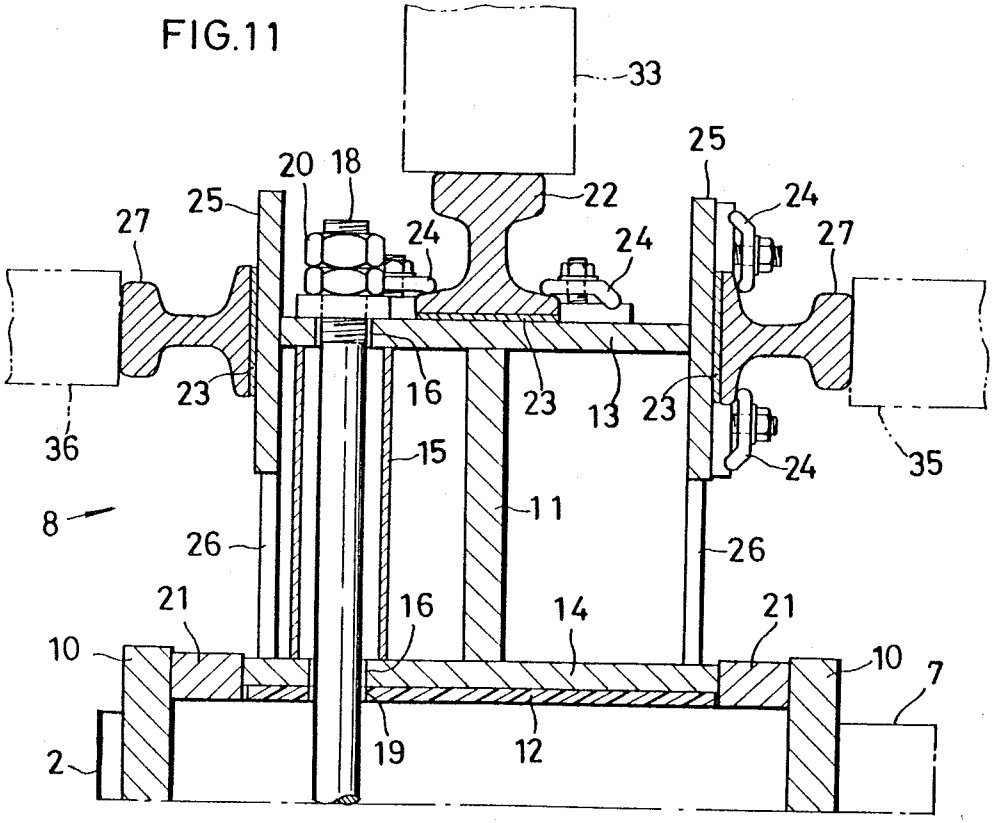
FIG. 11 is an enlarged view in section taken along the line S11—S11.

FIG. 11 shows the upper track 8 in detail. Two girder support plates 10 extending horizontally along the side wall 2 are vertically implanted in the horizontal stepped portion 7, and the upper ends of the plates 10 project upward slightly beyond the stepped portion 7. Between these support plates 10, a girder 11 approximately I-shaped in cross section is mounted on the stepped portion 7, with a synthetic resin liner 12 interposed therebetween. A multiplicity of vertical support pipes 15 interconnecting a top plate 13 and a bottom plate 14 are secured at opposite side portions of the girder 11. Bolt holes 16 are formed in the top plate 13 and the bottom plate 14 in alignment with these pipes 15. A multiplicity of foundation bolts 18 implanted vertically in the stepped portion 7 extend through bolt holes 19 in the liner 12, the bolt holes 16 in the bottom plate 14, the pipes 15 and the bolt holes 16 in the top plate 13 slightly beyond the top plate. Nuts 20 are screwed on the projecting ends, whereby the girder 11 is secured to the stepped portion 7. Stoppers 21 for preventing the displacement of the girder 11 widthwise thereof are fixedly provided between the opposite sides of the bottom plate 14 and opposed support plates 10. A vertical wheel rail 22 is centrally mounted on the upper side of the girder top plate 13 with a liner 23 interposed therebetween and secured in place by a multiplicity of rail clips 24. Vertical rail support plates 25 are secured to opposite sides of the girder top plate 13. A multiplicity of vertical support plates 26 are fixedly provided between the lower ends of the plates 25 and the girder bottom plate 14. Horizontal wheel rails 27 are similarly secured to the outer sides of the opposed rail support plates 25.

Figure 12:
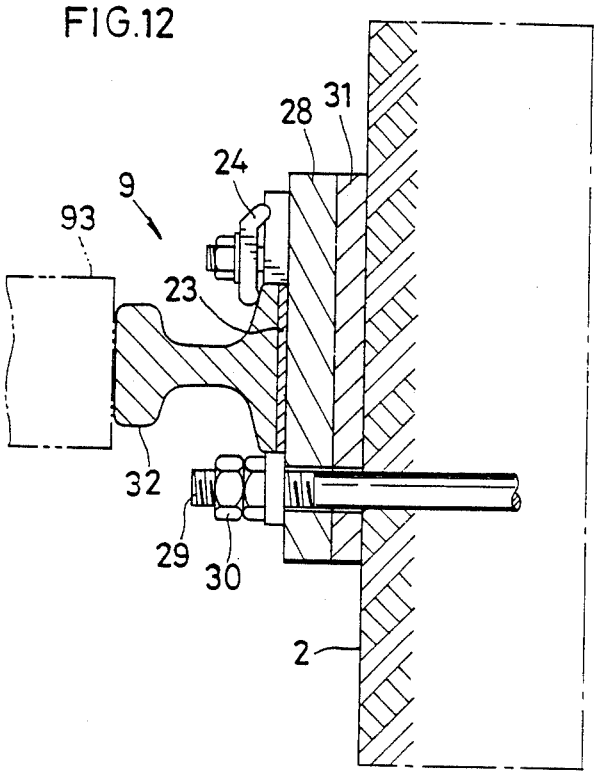
FIG. 12 is an enlarged view in section taken along the line S12—S12 in FIG. 2.
Figure 13:
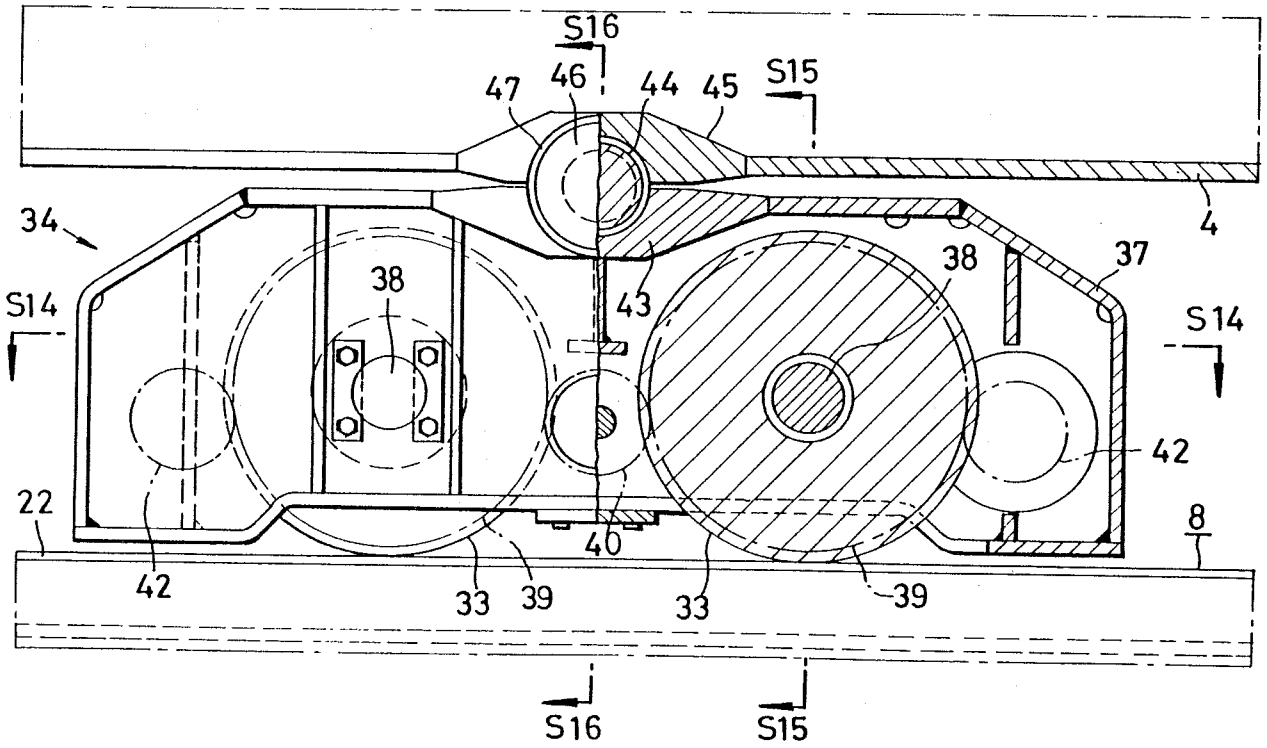
FIG. 13 is a plan view partly broken away and showing a running drive unit on the drive truck on an enlarged scale.
Figure 14:
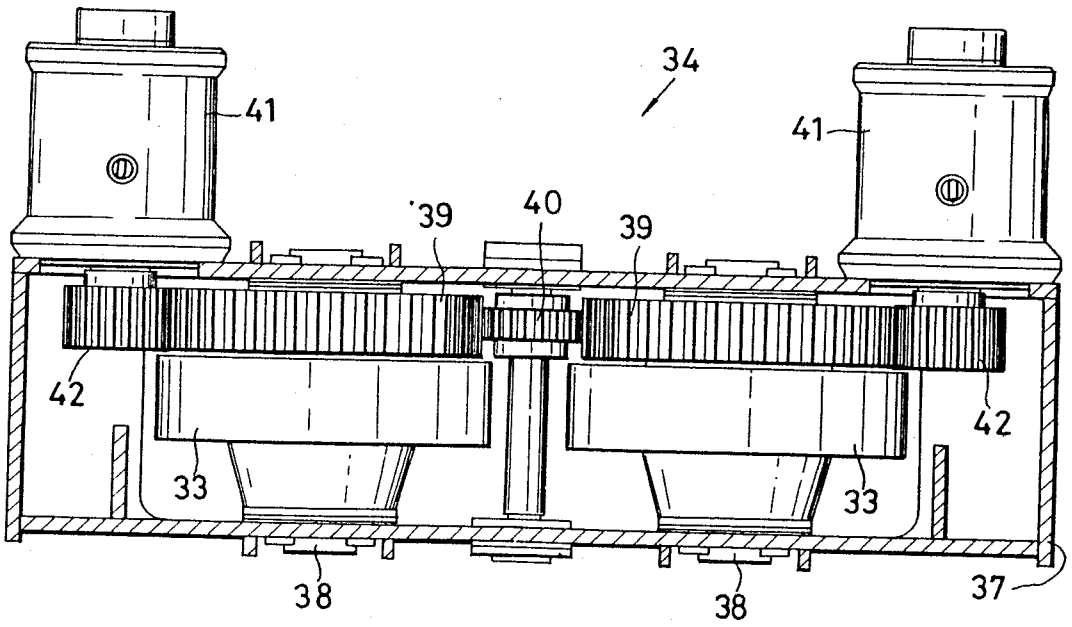
FIG. 14 is a view in section taken along the line S14—S14 in FIG. 13.
Figure 16:
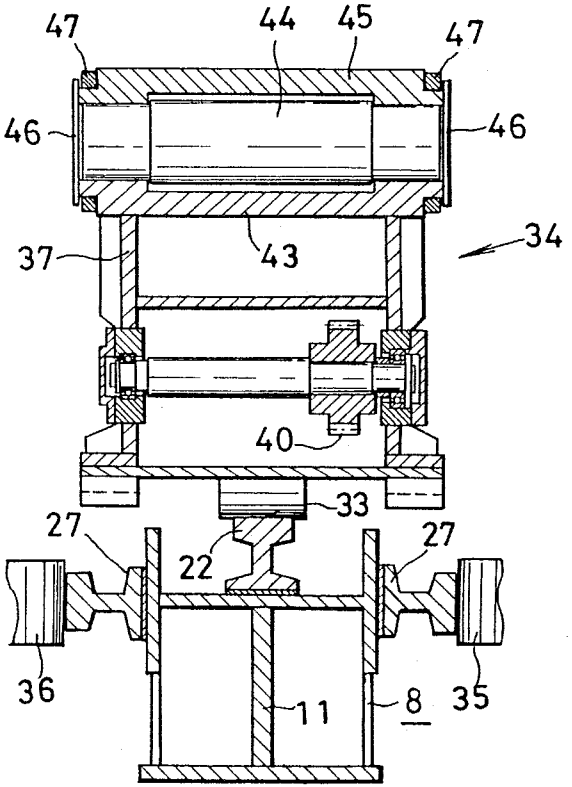
FIG. 16 is a view in section taken along the line S16—S16 in FIG. 13.
Figure 15:
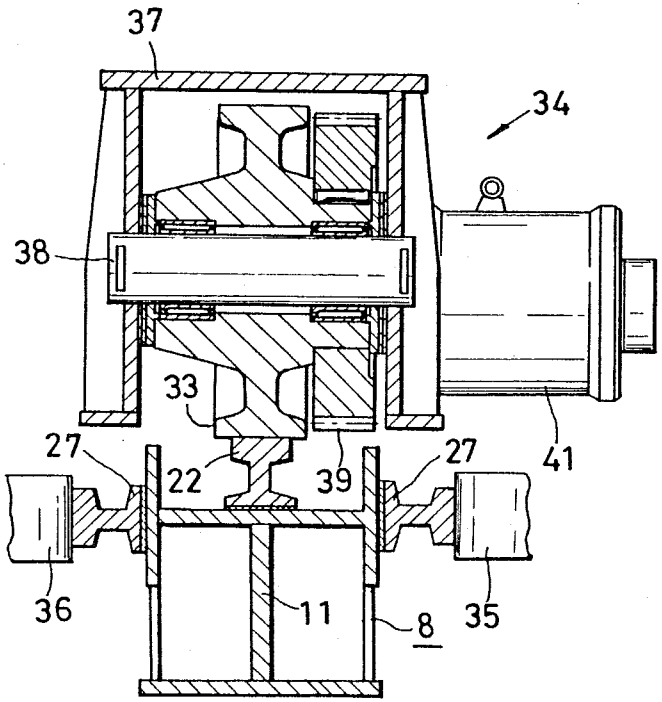
FIG. 15 is a view in section taken along the line S15—S15 in FIG. 13.
Figure 17:
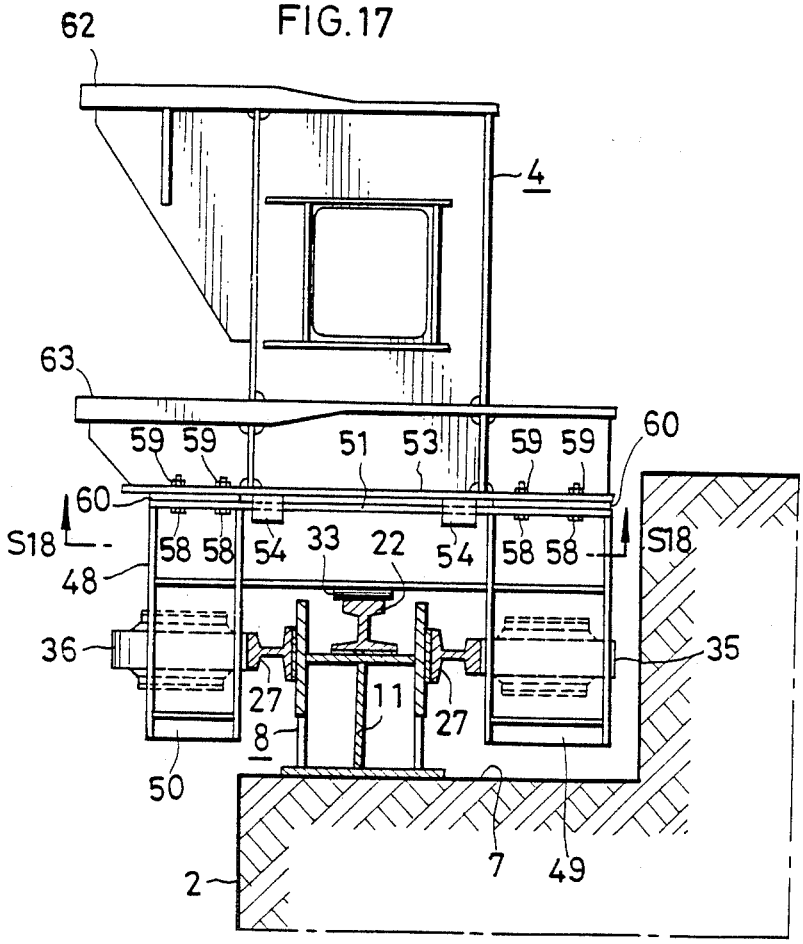
FIG. 17 is a view showing the apparatus at it is seen along the line S17—S17 in FIG. 2.
Figure 19:
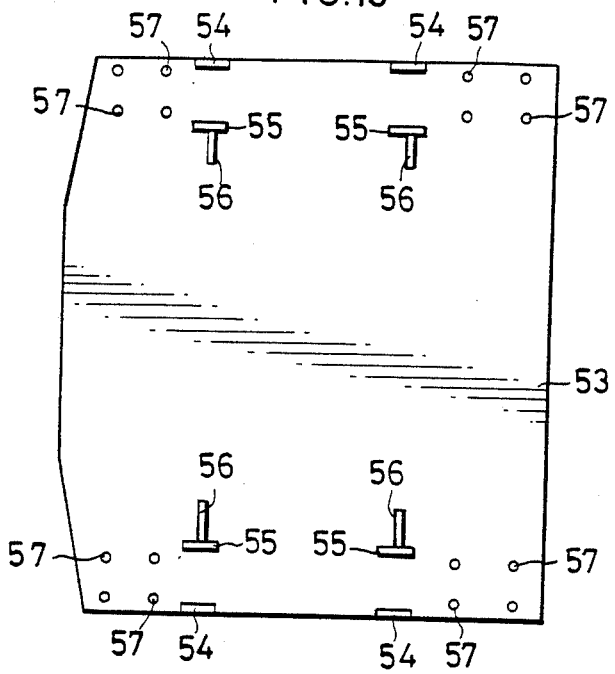
FIG. 19 is a bottom view showing a housing support plate for the drive truck with a horizontal wheel housing removed from FIG. 18.
Figure 18:
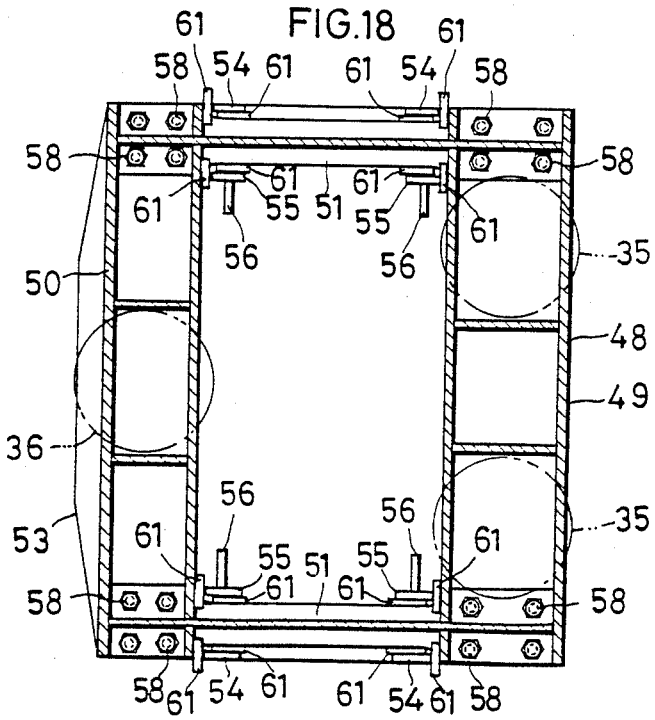
FIG. 18 is an enlarged view in section taken along the line S18—S18 in FIG. 17.
Figure 20:
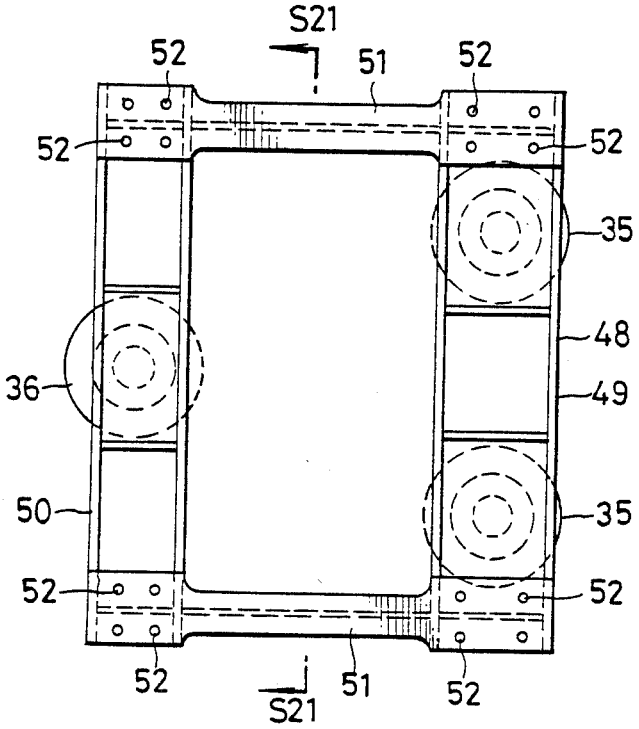
FIG. 20 is a plan view showing the horizontal wheel housing of the drive truck.
Figure 21:
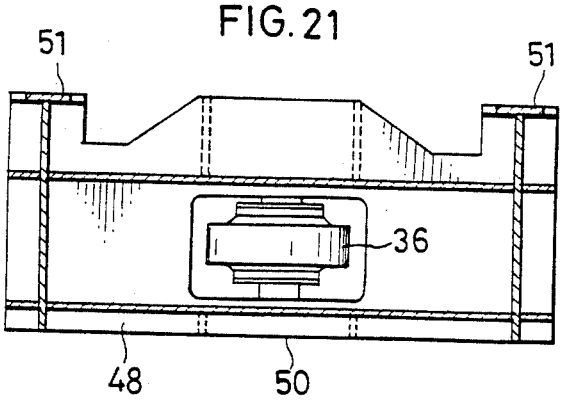
FIG. 21 is a view in section taken along the line S21—S21 in FIG. 20.

FIG. 12 shows the lower track 9 in detail. A rail support plate 28 extending horizontally along the side wall 2 is vertically fixed to the side wall 2 at a lower portion thereof by many foundation bolts 29 horizontally implanted in the side wall 2 in upper and lower two rows and nuts 30 screwed on the bolts, with a liner 31 interposed between the plate 28 and the wall 2. As is the case with the upper track 8, a horizontal wheel rail 32 is fixed to the support plate 28.

Figure 2:
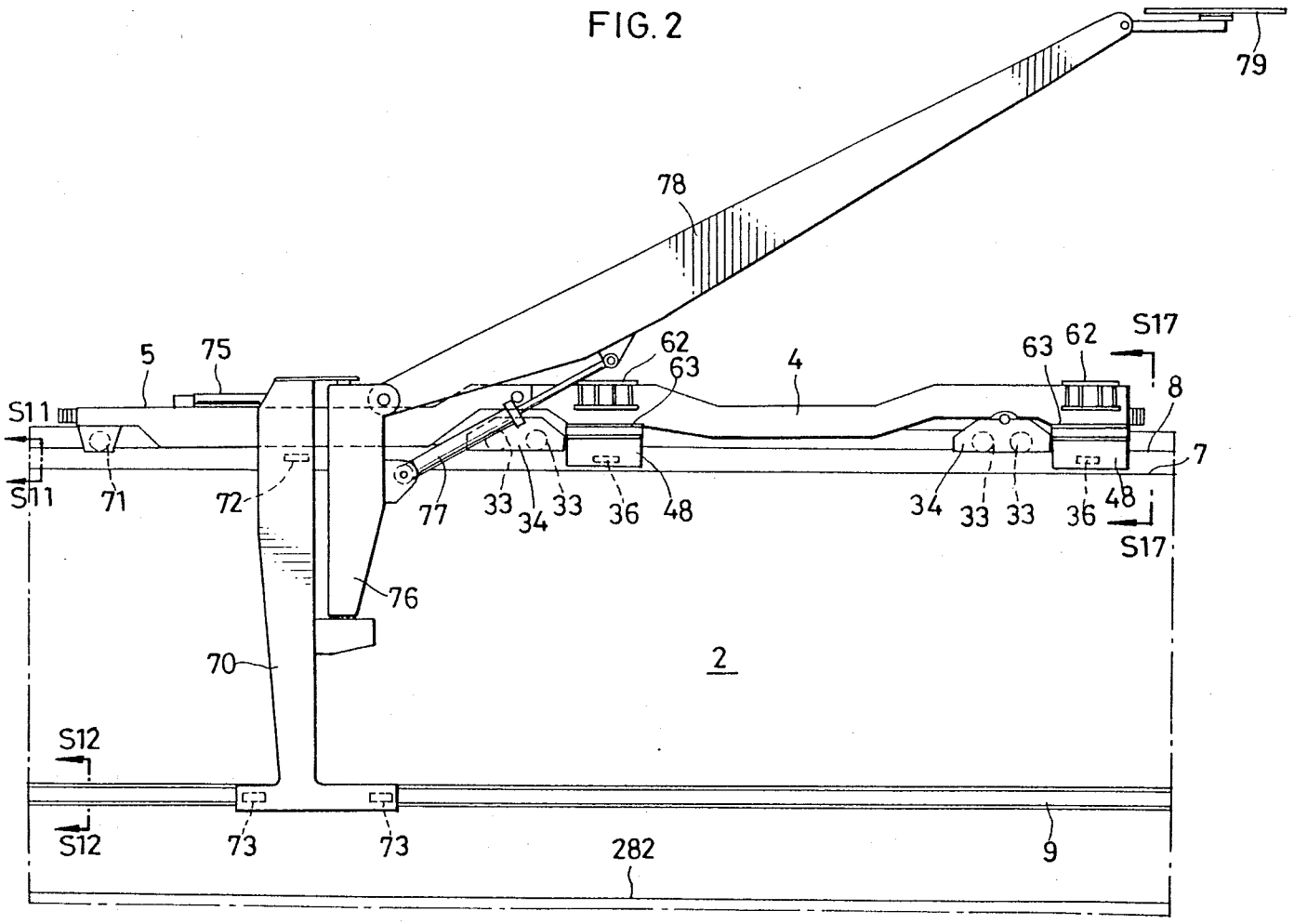
FIG. 2 is a front view showing a drive truck and a surface treating truck.
Figure 3:
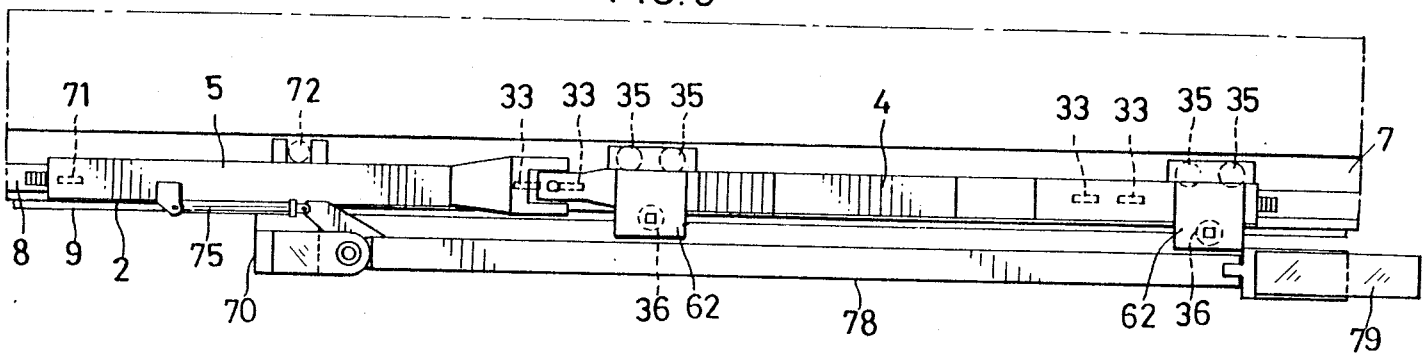
FIG. 3 is a plan view of the same.
Figure 4:
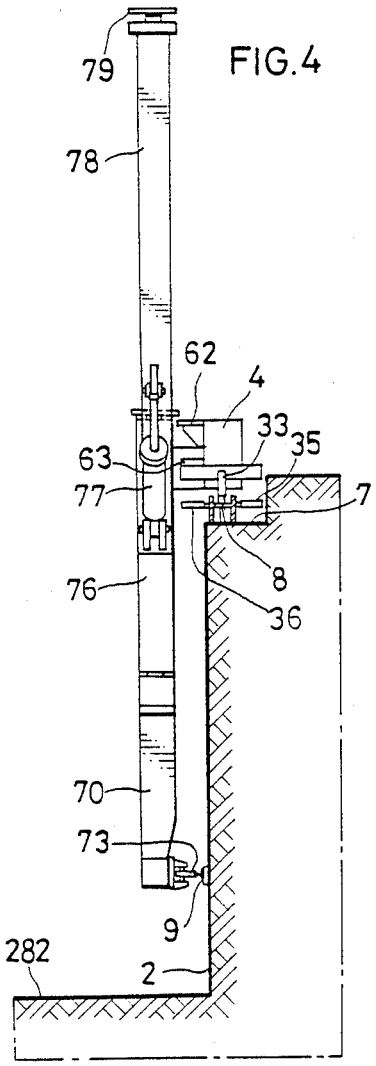
FIG. 4 is a side elevation of the same.
Figure 10:
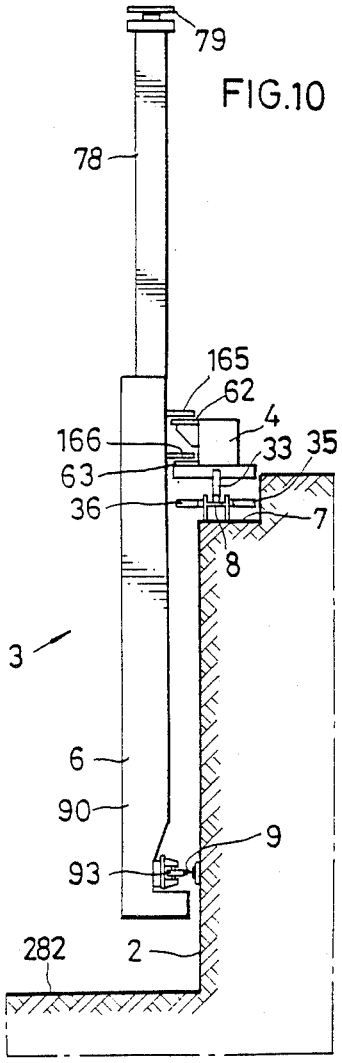
FIG. 10 is a side elevation showing the same.

As seen in FIGS. 2 to 4, the drive track 4 is elongated along the upper track 8. A running drive unit 34 having two vertical drive wheels 33, and three horizontal wheels 35, 36 are attached to each end of the truck 4 on the bottom thereof. The drive truck 4 is self-movably mounted on the upper track 8 in the following manner by the drive units 34 and the horizontal wheels 35, 36.

FIGS. 13 to 16 show the drive unit 34 in detail. The drive unit 34 is provided with a frame 37 which is attached to the bottom of the truck 4 as will be described later. Two horizontal axles 38 at right angles with the upper track 8 are fixed to the frame 37. Two drive wheels 33 having equal outside diameters are rotatably mounted on these axles 38 and are placed on the vertical wheel rail 22 of the upper track 8. The two axles 38 are also provided with same gears 39 which are rotatable with the drive wheels 33 and which are in mesh with an idle gear 40 rotatably supported by the frame 37. Hydraulic motors 41 are attached to the side of the frame 37 outside the dock and positioned toward opposite ends of the frame. The same pinions 42 mounted on the motors 41 are in mesh with the drive wheel gears 39 in corresponding relation. A pin 44 parallel with the axle 38 is rotatably supported at about one half of the lower side of its opposit ends by a bearing 43 which is fixed to the top side of the frame 37 centrally thereof. A bearing 45 fixed to the bottom of the drive truck 4 is placed on the pin 44, and about one half of the upper side of each end of the pin 44 is rotatably fitted to the upper bearing 45. There is a small clearance between the upper and lower bearings 45, 43, and the frame 37 of the drive unit 34 is slightly rotatable about the pin 44 relative to the truck 4. Disks 46 are secured to opposite end faces of the pin 44. Stoppers 47 are provided around the pin 44 between the disks 46 and opposite ends of the bearings 45, 43 for preventing the displacement of the pin 44 longitudinally thereof.

With reference to FIGS. 17 to 22, the three horizontal wheels 35, 36 are provided with a housing 48. Such two housings 48 are fixed to the bottom of the drive truck 4 slightly inwardly of the dock from the drive unit 34 in the following manner. The housing 48 is in the form of a rectangular frame comprising horizontal wheel support portions 49, 50 at opposite sides and connecting portions 51 interconnecting upper parts of these portions toward their opposite ends. The opposite ends of the support portions 49, 50 slightly project beyond the connecting portions 51. The four corners of the housing 48 have bolt holes 52 each. The horizontal wheels 35, 36 are rotatably mounted on the support portion 49 at two locations slightly inward from the bolt holes 52 and on the other support portion 50 at one location at the center thereof. On the other hand, a housing support plate 53 is horizontally fixed to the bottom of the truck 4. Four pairs of stoppers 54, 55, each in the form of a vertical plate, is attached to the lower side of the plate 53 at right angles to the upper rail 8. The stoppers of each pair are spaced apart by a distance longitudinally of the truck 4. The four pairs of stoppers 54, 55 are spaced apart by a distance longitudinally of the truck 4, as well as widthwise thereof, to define a rectangle. Vertical reinforcing plates 56 are fixedly connected between the lower side of the housing support plate 53 and the inner side faces of the four stoppers 55 which are positioned inwardly of the truck 4 lengthwise thereof. Bolt holes 57 corresponding to the bolts holes 52 of the housing 48 are formed in the support plate 53 between the pairs of stoppers 54, 55 and the widthwise opposite ends of the truck. The housing 48 is fixed to the support plate 53 by bolts 58 each extending through the corresponding bolts holes 52, 57 and nuts 59 screwed on the bolts. A liner 60 is interposed between the housing 48 and the support plate 53 at each of the four corners. Each connecting portion 51 of the housing 48 at a part thereof toward each end thereof is fitted in the space between the outer stopper 54 and the inner stopper 55 on the lower side of the support plate 53 with some clearance. Liners 61 are held between the connecting portion 51 and the outer stopper 54, between the portion 51 and the inner stopper 55, between the horizontal wheel support portions 49, 50 and the outer ends of the outer stoppers 54 and between the support portions 49, 50 and the outer ends of the inner stoppers 55. The liners 61 are spot-welded to the stoppers 54 or 55. The two horizontal wheels 35 on the support portion 49 are in contact with the outer rail 27 of the upper track 8, while one horizontal wheel 36 on the other support portion 50 is in contact with the inner rail 27.

The drive unit 34 and the horizontal wheels 35, 36 are installed in the following manner.

First, the drive wheels 33 of the two drive units 34 are placed on the rail 22 at a suitable location, and the two housings 48 having the horizontal wheels 35, 36 attached thereto are placed on the upper track 8 at a suitable location, with the opposed rails 27 held between the horizontal wheels 35, 36. The bearings 45 on the drive truck 4 are placed on the pins 44 on the bearings 43 of the drive units 34, whereby the truck 4 are mounted on the drive units 34. Next, each housing 48 is lifted, and the connecting portions 51 are fitted into the spaces between the outer stoppers 54 and the inner stoppers 55 on the support plate 53. The housing 48 and the support plate 53 are temporarily fastened together by bolts 58 and nuts 59. At this time, the level of the horisontal wheels 35, 36 is adjusted by the liners 60 between the housing 48 and the support plate 53. The positions of the three horizontal wheels 35, 36 in a horizontal plane are so adjusted that the wheels will be in uniform contact with the rails 27. The liners 61 are placed between the housing 48 and the stoppers 54, 55 and are spot-welded to the stoppers 54 or 55. Finally each housing 48 is completely fastened to the support plate 53 by tightening up the bolts 58 and nuts 59.

As shown in detail in FIGS. 32 to 41, a pair of upper and lower connecting plates 62, 63 extending horizontally above the inner horizontal wheel 36 is fixed to the inner side of the drive truck 4, as positioned toward each end of the truck 4. The connecting plates 62, 63 are each formed with a rectangular vertical connecting bore 64 in its center. A flanged vertical connecting pin guide 65 in the form of a square tube is fitted in each bore 64 from above (see FIGS. 38 to 40). An oilless liner 66 is fixedly fitted in the guide 65 and is tapered obliquely upward on its inner side toward the upper end. The flange upper surface of the guide 65 on the upper connecting plate 62 provides a horizontal connecting surface 74. Square connecting blocks 67 are horizontally secured to the upper side of the upper connecting plate 62 toward its opposite ends. The upper surfaces of the blocks 67 serve as horizontal pin bearing surfaces 98. The block 67 has obliquely upward slanting faces 68 at its opposite sides (laterally inner and outer sides with respect to the dock, see FIG. 41). A temporarily connecting hook 69 extending inward of the dock and then bent upward is fixed to the side of the inner horizontal wheel support portion 50 of each of the two housings 48 of the drive truck 4 (see FIGS. 32 to 37)

With reference to FIGS. 2 to 4, the surface treating truck 5 is slender and positioned on the upper truck 8 therealong. A leg 70 extending vertically along the dock side wall 2 is fixed at an upper portion thereof to the midportion of the truck 5 on the inner side. A vertical driven wheel 71 rollable on the vertical wheel rail 22 of the upper truck 8 is attached to the bottom of the truck 5 at the end thereof closer to the dock inlet. As is the case with the drive truck 4, two horizontal wheels 72 rollable on the opposite horizontal wheel rails 27 of the upper track 8 are attached to the midportion of the truck 5 on the bottom side. Two horizontal wheels 73 rollable on the rail 32 of the lower track 9 are mounted on the lower ends of the leg 70. As will be described later, the surface treating truck 5 is connected to the end of the drive truck 4 which end is closer to the dock inlet and is adapted to run along the upper and lower tracks 8 and 9.

The surface treating truck 5 is provided with a hull surface treating device. The device, which performs a sequence of hull surface treating operations as will be described, has the following construction as known. A post 76 swivellable about a vertical axis by a hydraulic cylinder 75 is attached to the upper portion of the leg 70. The post 76 is provided with a jib 78 pivotally movable upward or downward by a hydraulic cylinder 77. A support 79 for carrying surface treating devices is attached to the forward end of the jib 78.

Figure 23:
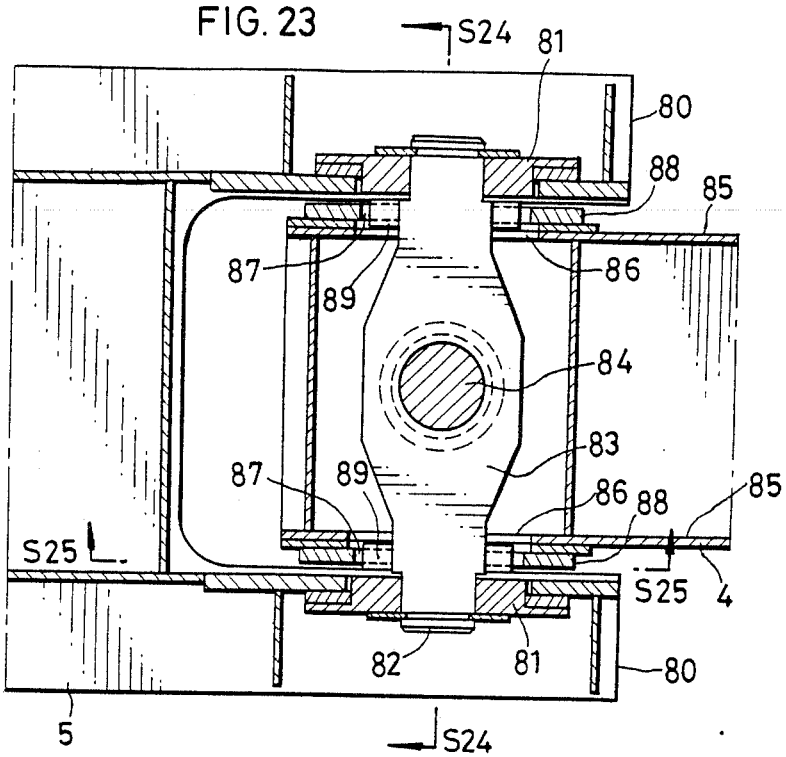
FIG. 23 is a view in horizontal section showing the connection between the drive truck and the surface treating truck.
Figure 22:
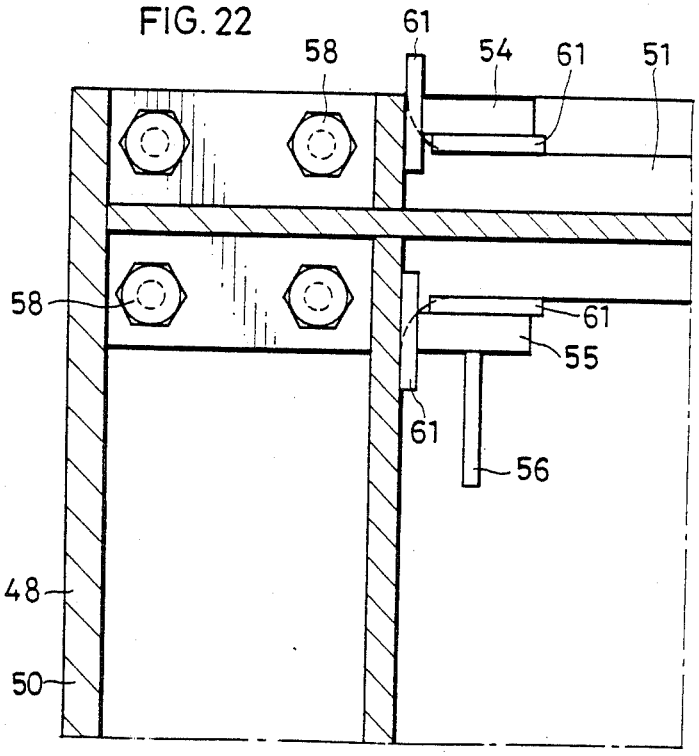
FIG. 22 is an enlarged fragmentary view of FIG. 18.
Figure 24:
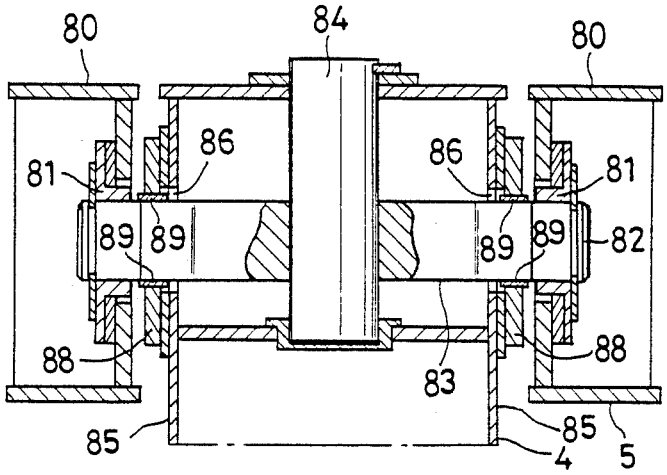
FIG. 24 is a view in section taken along the line S24—S24 in FIG. 23.
Figure 25:
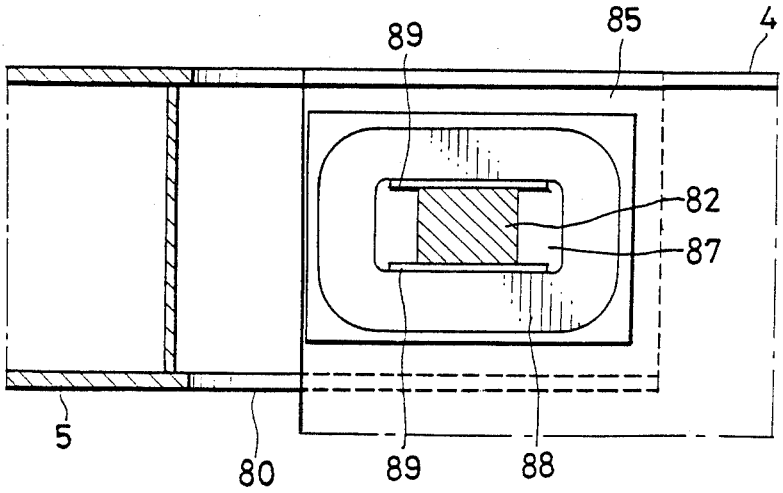
FIG. 25 is a view in section taken along the line S25—S25 in FIG. 23.

FIGS. 23 to 25 show in detail the connection between the drive truck 4 and the surface treating truck 5. At the end of the truck 5 which end is inward of the dock, bifurcated projections 80 extend horizontally from the inner and outer sides of the truck 5 inward of the dock. The end of the truck 4 toward the inlet of the dock extends into the space between the projections 80. Bearings 81 are fixed to the opposed portions of the two projections 80. A horizontal pin 82 extending through the end of the truck 4 is rotatably supported at its opposite ends by the bearings 81. The portion of the pin 82 which extends through the truck 4 is flat and has horizontal upper and lower surfaces. The center part of this portion has a slightly larger width than the other portion. A vertical pin 84 rotatably extending through the center of the flat portion 83 of the pin 82 has upper and lower ends which are secured to the drive truck 4. Opposite side plates 85 of the drive truck 4 are formed with horizontally elongaged rectangular openings 86. Horizontal pin support plates 88 having openings 87 similar to but slightly smaller than the openings 86 are secured to the plates 85 outside the openings 86. The end parts of the pin flat portion 83 extend through the openings 86, 87. The horizontal width of the openings of the support plates 88 is considerably larger than the horizontal width of these parts of the pin 82. To the upper and lower edges of the support plate 88 defining the opening 87 are secured bearing plates 89 in sliding contact with the upper and lower surfaces of the pin flat portion 83. While the horizontal pin 82 is prevented from rotating about its center line or moving upward or downward relative to the drive truck 4, the pin 82 is rotatable about the vertical pin 84 by being guided by the upper and lower bearing plates 89. The drive truck 4 and the surface treating truck 5 are rotatable about the horizontal pin 82 by an amount relative to each other and are also rotatable about the vertical pin 84 by an amount relative to each other. However, the portions of the horizontal pin 82 close to their opposite ends are held by the trucks 4 and 5 against upward or downward movement, so that a twist around an axis parallel to the upper track 8 is delivered from one of the trucks 4 and 5 directly to the other. Thus the trucks 4 and 5 will not twist relative to each other at the connection.

Figure 6:
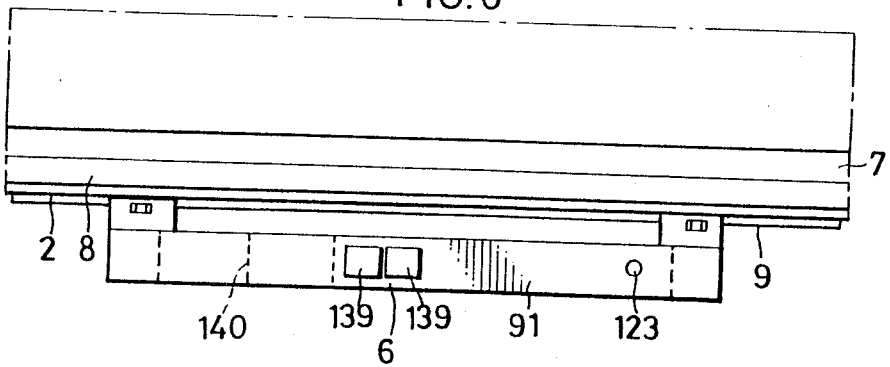
FIG. 6 is a plan view of the same.
Figure 7:
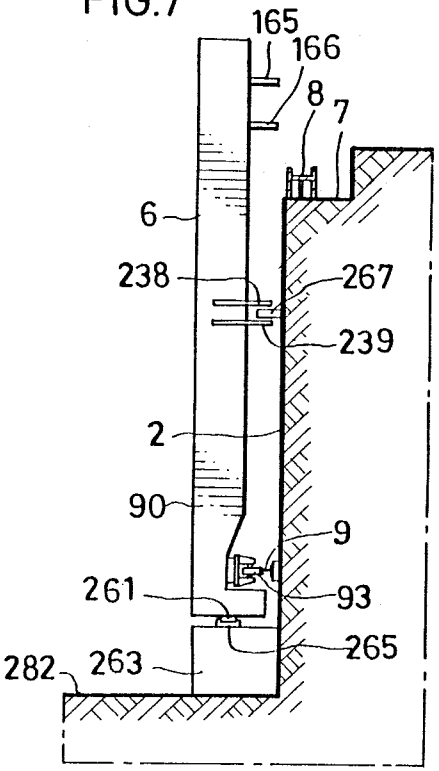
FIG. 7 is a side elevation of the same.
Figure 5:
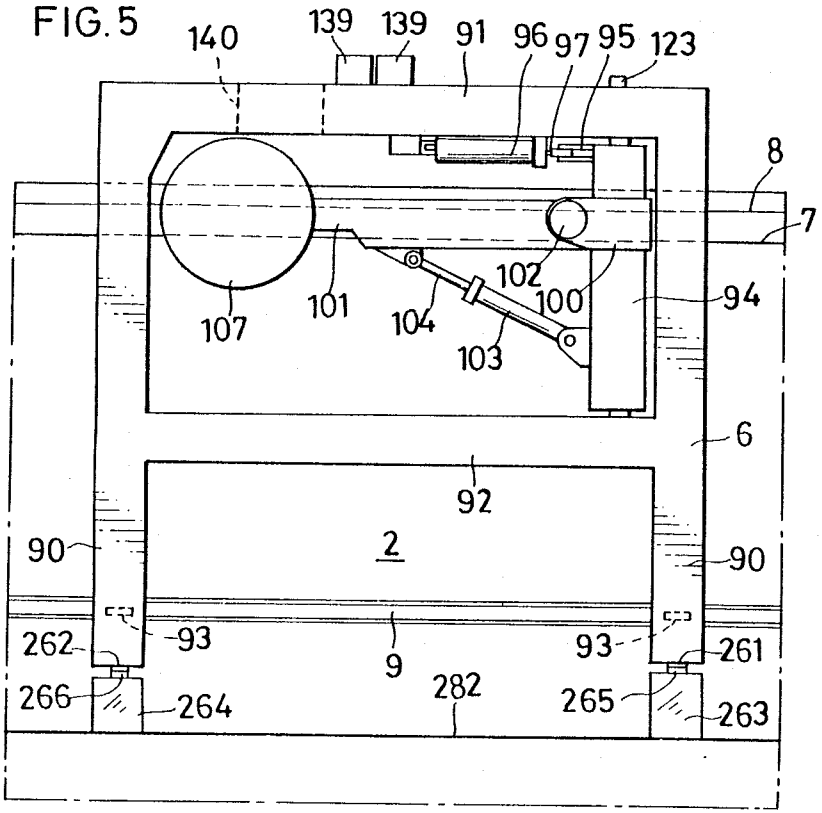
FIG. 5 is a front view of a docking truck.

With reference to FIGS. 5 to 7, the docking truck 6 comprises a pair of legs 90 extending vertically along the dock side wall 2 and upper and lower horizontal portions 91, 92 interconnecting the legs 90 at their upper ends and intermediate portions slightly lower than the lengthwise midportions thereof. Horizontal wheels 93 rollable on the rail 32 of the lower track 9 are mounted on the lower ends of the legs 90.

Toward the innermost portion of the dock, a vertical swivel post 94 is rotatably supported at its upper and lower ends by the upper and lower horizontal portions 91, 92 of the truck 6. Horizontal levers 95 are fixed to the upper end of the post 94. The base end of a swivelling hydraulic cylinder 96 and the forward end of the piston rod 97 thereof are respectively pivoted to the midportion of the upper horizontal portion 91 and the free ends of the levers 95 by vertical pins. Slightly below the levers 95, a vertical bracket 100 is secured to the outer periphery of the swivel post 94. A suction disk arm 101 is pivoted at its base end to the bracket 100 by a horizontal pin 102. The base end of an inclining hydraulic cylinder 103 and the forward end of its piston rod 104 are respectively pivoted to a lower portion of the swivel post 94 and the midportion of the arm 101 on its bottom side by horizontal pins. A hull suction disk 107 of the vacuum type which is tiltable as desired to face the hull is connected to the free end of the arm 101 in the following manner (see FIGS. 26 to 28). A first pin 108 rotatably extends through the free end of the arm 101 which end is bifurcated into upper and lower parts. A disk support member 110 has one end inserted between the bifurcated portions 109 and fixed to the midportion of the pin 108. The other end of the member 110 is pivoted to the rear side of the disk 107 at the center thereof by a second pin 111 which is at right angles to the first pin 108. A hydraulic cylinder 112 for rotating the suction disk 107 about the first pin 108 is connected between the arm 101 and the free end of a lever 113 which is connected to the side surface of the lower end of the first pin 108 projecting downward from the arm 101 and which is at right angles to the pin end. A hydraulic cylinder 114 for rotating the suction disk 107 about the second pin 111 is connected between the lower end face of the first pin 108 and the lower end of the disk 107. The suction disk 107 itself is known and will not be described.

Figure 29:
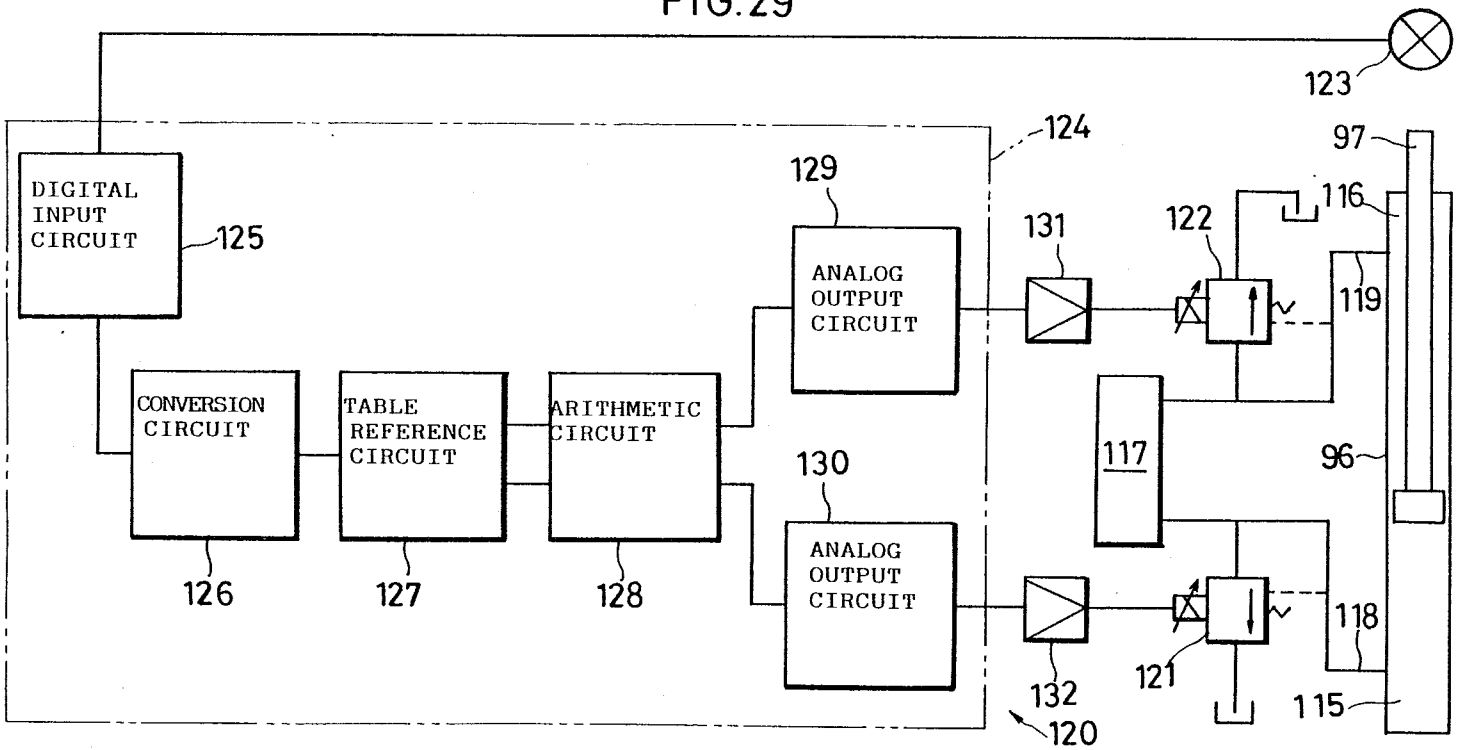
FIG. 29 is a diagram showing the hydraulic and electric systems of a hydraulic control unit for a swivelling hydraulic cylinder on the docking truck.

With reference to FIG. 29, the swivelling hydraulic cylinder 96 of the docking truck 6 has two oil chambers 115 and 116, to which two oil pipes 118 and 119 of a swivelling hydraulic circuit 117 are connected respectively, whereby the arm 101 is swivelled about the post 94 between a position wherein the suction disk 107 is retracted in the space between the upper and lower horizontal portions 91, 92 and an advanced position inward of the dock. The truck 6 is further provided with a hydraulic control system 120 for the swivelling hydraulic cylinder 96 as will be described below. Electromagnetic proportional relief valves 121 and 122, which are settable to varying pressures by electric signals (current), are respectively connected to the two oil pipes 118 and 119 for the cylinder 96. An angle sensor 123 for detecting the swivelling angle of the post 94, i.e., of the arm 101, is mounted on the top of the upper horizontal portion 91 of the truck 6 (see FIGS. 5 and 6). Provided between the sensor 123 and the two relief valves 121, 122 is an arithmetic control unit 124 for controlling the pressure settings of the valves 121, 122 individually according to the swivelling angle of the arm 101. The control unit 124 comprises a digital input circuit 125, a conversion circuit 126, a table reference circuit 127, an arithmetic circuit 128 and two analog output circuits 129, 130. Amplifiers 131, 132 are interposed between the analog output circuits 129, 130 and the corresponding relief valves 121, 122, respectively.

The arithmetic control unit 124 comprises, for example, a sequence controller. As will be described in detail later, the horizontal force acting on the forward end of the arm 101 at right angles with the truck 6 is controlled to a value not greater than a permissible limit by the control system 120.

Figure 30:
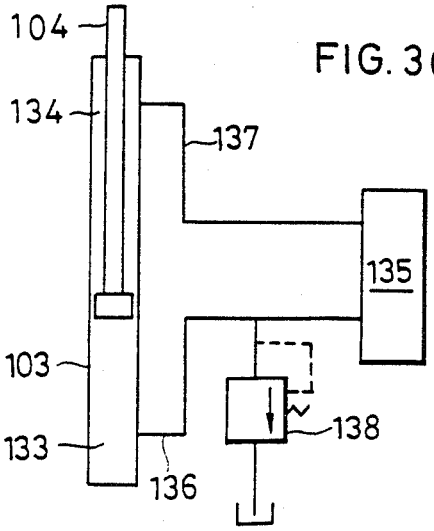
FIG. 30 is a diagram showing the hydraulic system of an inclining hydraulic cylinder on the docking truck.
Figure 27:
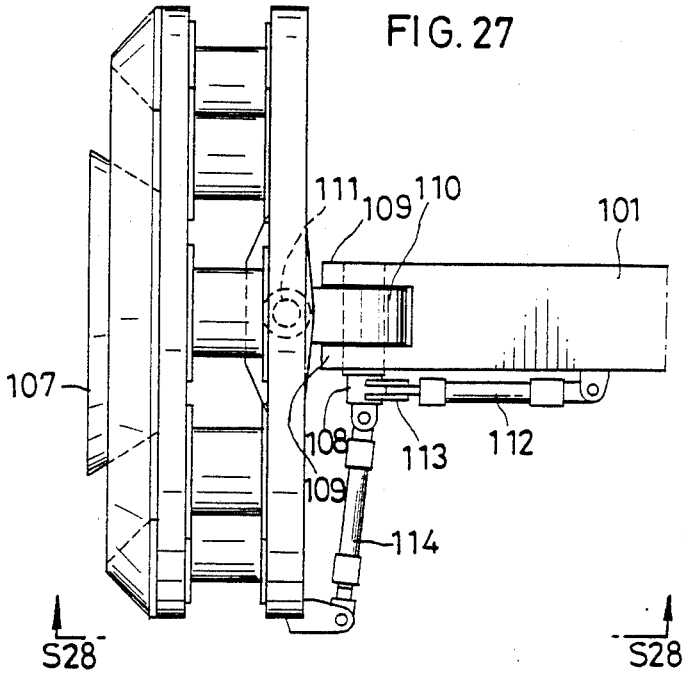
FIG. 27 is an enlarged view showing the same as it is seen along the line S27—S27 in FIG. 26.
Figure 28:
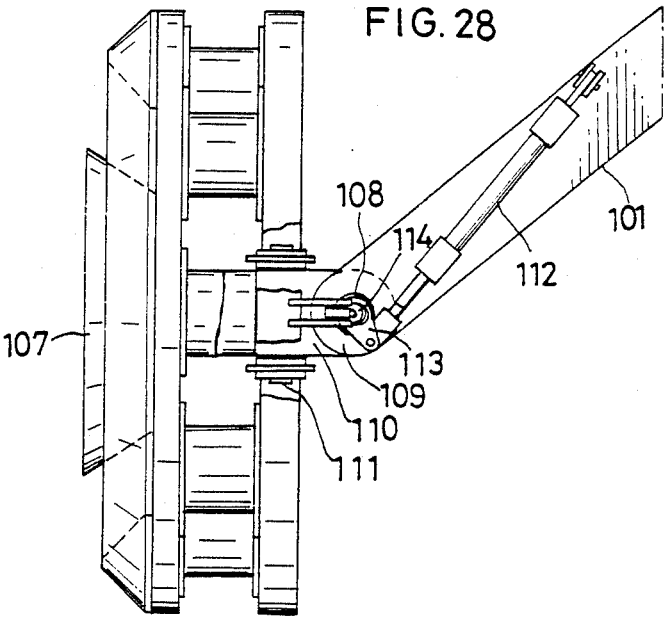
FIG. 28 is a view showing the same as it is seen along the line S28—S28 in FIG. 27.

As seen in FIG. 30, the inclining hydraulic cylinder 103 of the docking truck 6 has two hydraulic chambers 133, 134, to which two oil pipes 136, 137 of an inclining hydraulic circuit 135 are connected respectively. The arm 101 is pivotally moved about the horizontal pin 102 between a substantially horizontal position and a downwardly inclined position, whereby the suction disk 107 is moved upward or downward between a position immediately below the upper horizontal portion 91 and a position immediately above the lower horizontal portion 92. The oil pipe 136 connected to the oil chamber 133 of the cylinder 103 toward its head is provided with a relief valve 138, which is set to a pressure slightly greater than the pressure required for supporting the arm 101 and the suction disk 107 against the gravity.

Figure 31:
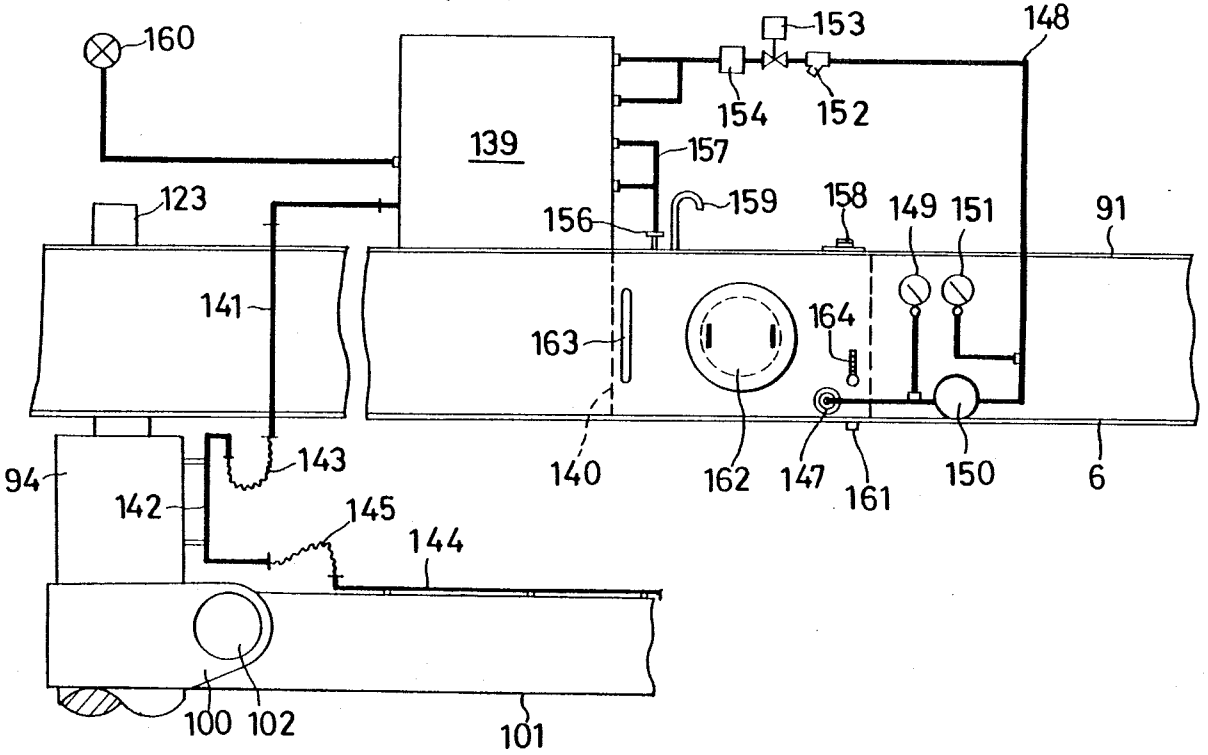
FIG. 31 is a diagram showing systems for the flow of air and water between the hull suction disk, vacuum pump units for the suction disk and a clean water tank which are provided on the docking truck.

With reference to FIG. 31, two vacuum pump units 139 including water-enclosed vaccum pumps for the suction disk are mounted on the upper horizontal portion 91 of the truck 6. A clean water tank 140 is provided within the portion 91 for the vacuum pump units. A flexible hose 143 is connected between a suction pipe 141 secured to the upper horizontal portion 91 and a suction pipe 141 secured to the swivel post 94, while a flexible hose 145 is connected between the other end of the suction pipe 142 on the post 94 and a suction pipe 144 secured to the arm 101. Although not shown, a flexible hose is also connected between the other end of the suction pipe 144 on the arm 101 and the suction disk 107. A water supply pipe 148 extends from a water supply outlet 147 of the water tank 140 at a lower portion of its outer side wall and is branched into two pipes which are connected to the vacuum pump units 139. Mounted on the pipe 148 are a pressure gauge 149, water pump 150, pressure gauge 151, Y-shaped strainer 152, electromagnetic valve 153 and flow switch 154 which are arranged in the order mentioned from the tank side to the branched portion. A water return pipe 157 extends from a return inlet 156 in the top wall of the water tank 140 and is branched into two pipes which are connected to the pump units 139. The top wall of the tank 140 is provided with a capped water injection opening 158 and a substantially inverted J-shaped air release pipe 159. A drain plug 161 is attached to the bottom wall of the tank 140, while the outer side wall thereof has a manhole 162 provided with a cover. The tank further has a water level gauge 163 and a thermometer 164 for the water. The pump units 139 are provided with a vacuum gauge 160 having a pressure switch.

As shown in detail in FIGS. 32 to 44, a pair of upper and lower connecting plates 165, 166 extending outward of the dock is secured to an upper portion of each of the opposed legs 90 of the docking truck 6. Each of the plates 165, 166 is centrally formed with a square vertical bore 167, in which an oilless liner 168 is fixedly fitted (see FIGS. 38 to 40, FIG. 43 and FIG. 44). A liner fixing plate 169 secured to the lower surface of the upper connecting plate 165 around the bore 167 has a lower surface which serves as a horizontal connecting surface 170 corresponding to the connecting surface 74 of the drive truck 4. The leg 90 has a top plate 171 which extends horizontally above the upper connecting plate 165 and which is connected to a side plate 173, outward of the dock, of the leg 90 and to the plate 165 by vertical plates 172. A horizontal guide plate 174 is secured to the upper side of the leg top plate 171 immediately above the bore 167, with a liner 175 interposed between the plates 174 and 171. Further fixed to the upper side of the guide plate 174 is a lower end plate 177 horizontally fixed to the lower end of a hydraulic cylinder support member 176 in the form of a vertical tube. A square guide bore 178 vertically extending through the top plate 171, liner 175 and plates 174, 177 is positioned immediately above the connecting bore 167. Within the guide bore 178, an oilless liner 179 is fixed to the guide plate 174. A connecting hydraulic cylinder 180 oriented vertically downward and disposed immediately above the guide bore 178 is secured at its lower end to a horizontal upper end plate 181 fixed to the upper end of the support member 176. The piston rod 182 of the cylinder 180 extends downward through the plate 181. A connecting pin 183 having a square cross section is disposed vertically in the support member 176. The lower end of the piston rod 182 is rotatably connected to the upper end of the pin 183 by a horizontal pin 184, a spherical bush 185, annular stoppers 186 and a retaining ring 187 (see FIG. 42). The connecting pin 183 is tapered at its lower end as at 188 and has a fall preventing cavity 189 positioned above the tapered portion 188 and formed in one side thereof facing outward of the dock. By the extension and retraction of the rod 182 of the cylinder 180, the connecting pin 183 is vertically movable between a lower limit position in which the pin 183 extends through the guide bores 178 and the connecting bores 167 in the upper and lower plates 165, 166 and slightly projects downward beyond the lower connecting plate 166 and an upper limit position wherein the lower end of the pin 183 is placed in the bore 167 of the upper connecting plate 165.

In corresponding relation to the connecting blocks 67 on the upper connecting plate 62 of the drive truck 4, horizontal hydraulic cylinder support plates 190 are fixedly provided above the upper connecting plate 165 of the docking truck 6 as positioned toward opposite ends of the plate 165. Two hydraulic cylinders 191, which are vertically downwardly oriented, are secured at their lower ends to these support plates 190. The piston rod 192 of each cylinder 191 extends through the support plate 190, and a lifting pin 193 extending vertically through the upper connecting plate 165 is fixed to the lower end of the rod 192. A fall preventing cavity 194 is formed in each lifting pin 193 on one side thereof facing outward of the dock. By the extension and retraction of the rod of the cylinder 191, the lifting pin 193 is vertically moved between a lower limit position wherein the pin 193 is projected downward slightly beyond the lower surface of the upper connecting plate 165 and an upper limit position wherein the lower end of the pin is slightly above the lower surface of the plate 165. At opposite sides of the lifting pin 193 widthwise of the dock, a pair of connecting blocks 195 are horizontally secured to the lower surface of the plate 165. In opposed relation to the slanting faces 68 of the connecting block 67 on the drive truck 4, downwardly slanting faces 196 are formed on the opposed sides of the blocks 195 (see FIG. 41).

Figure 41:
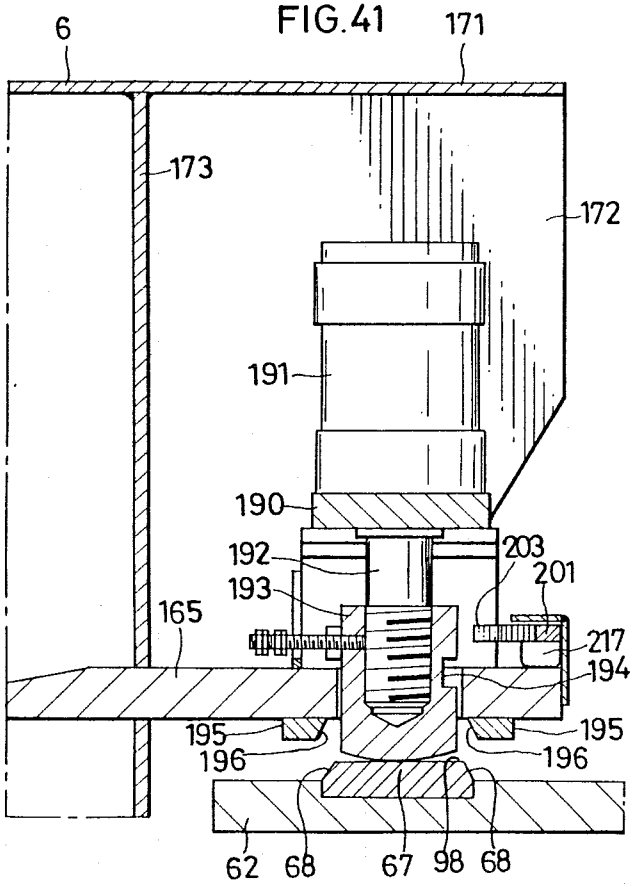
FIG. 41 is an enlarged view in section taken along the line S41—S41 in FIG. 39.
Figure 43:
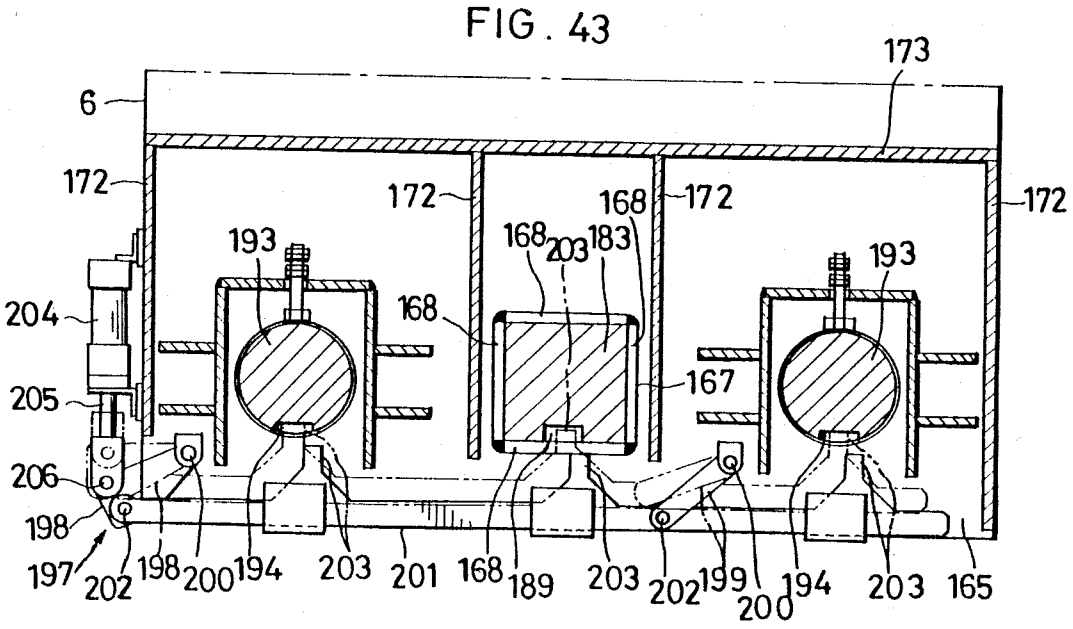
FIG. 43 is an enlarged view in section taken along the line S43—S43 in FIG. 40.
Figure 50:
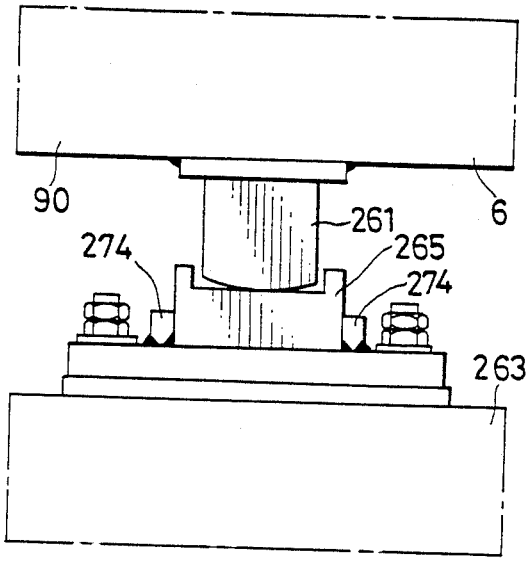
FIG. 50 is an enlarged fragmentary view of FIG. 34 (*a*)
Figure 44:
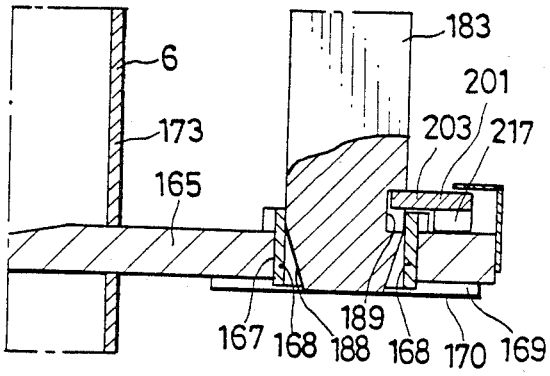
FIG. 44 is an enlarged view in section taken along the line S44—S44 in FIG. 40 and showing a projection on a fall preventing plate as advanced into a recess portion in a connecting pin.

The upper connecting plate 165 of the docking truck 6 is provided with an assembly 197 for preventing the connecting pin 183 and the lifting pins 193 from falling as described below (see FIGS. 41, 43 and 44). Between one end of the plate 165 and the lifting pin 193 adjacent thereto and between the connecting pin 183 and the other lifting pin 193, horizontal levers 198 and 199 are respectively pivoted, each at one end, to the upper surface of the plate 165 by vertical pins 200, as positioned toward one side of the plate outward of the dock. The other ends of these levers 198, 199 are pivoted by vertical pins 202 to two portions of a fall preventing plate 201 which is disposed horizontally along the above-mentioned side of the plate 165. The plate 201 is integrally formed with three projections 203 horizontally projecting inward of the dock in corresponding relation to the cavities 189 and 194 of the connecting pin 183 and the lifting pins 193. A fall preventing hydraulic cylinder 204 is horizontally secured to an outside lower portion of the vertical plate 172 close to the lever 198 on the upper connecting plate 165. The cylinder 204 has a piston rod 205, the forward end of which is pivoted to the lever 198 by a vertical pin 206. By the retraction or extension of the rod 205 of the cylinder 204, the two levers 198 and 199 are pivotally moved, with the result that the fall preventing plate 201 is moved toward or away from the connecting pin 183 and the lifting pins 193 while being held in parallel with the dock side wall 2. The plate 201 is supported by blocks 217 attached to its underside and in contact with the upper surface of the plate 165.

Figure 45:
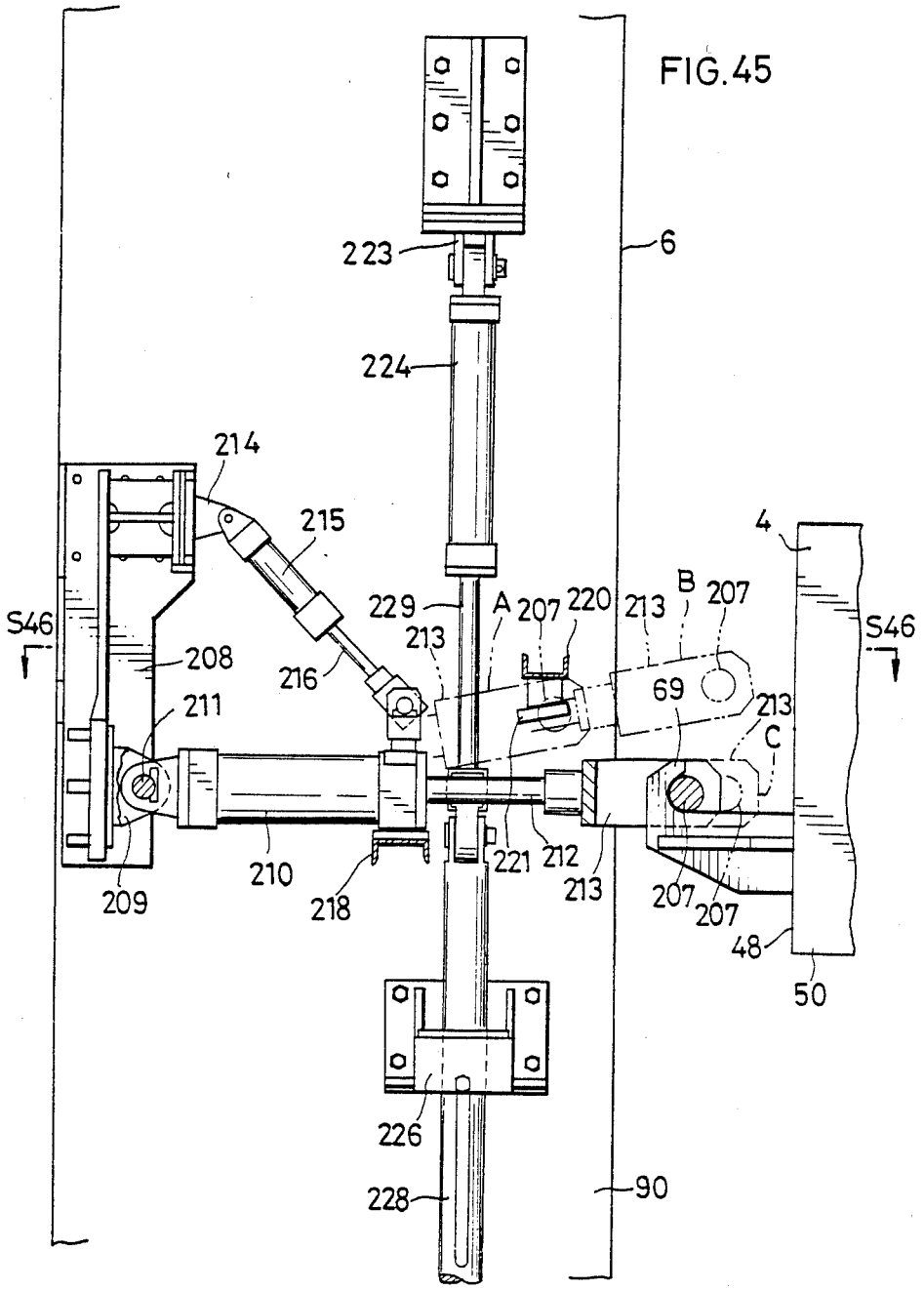
FIG. 45 is an enlarged fragmentary view of FIG. 35 (*a*) partly broken away.
Figure 46:
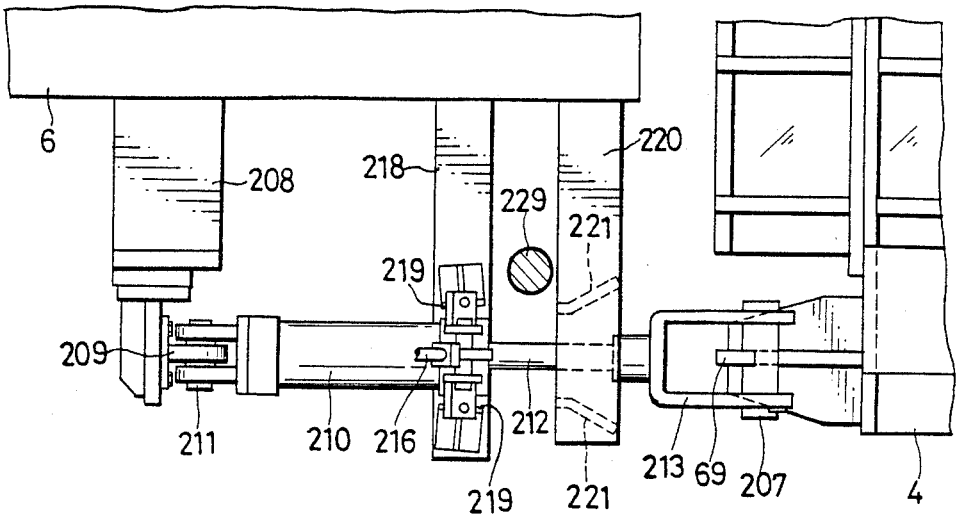
FIG. 46 is a view showing the same portion as it is seen along the line S46—S46 in FIG. 45.

As shown in detail in FIGS. 45 and 46, the sides of the legs 90 of the docking truck 6 which sides are outer and face the inelt end and the other end of the dock are each provided at an upper portion thereof with a pin 207 corresponding to the temporarily connecting hook 69 on the drive truck 4. To an upper portion of the outer side of each leg 90 is fixed a hydraulic cylinder support member 208, which is fixedly provided with a vertical bracket 209 at a lower portion thereof. A hydraulic cylinder 210 is pivoted at the base portion thereof to the bracket 209 by a horizontal pin 211 parallel to the dock wall 2, a spherical bush and annular stopper (not shown). The piston rod 212 of the cylinder 210 extends outward of the dock and has a U-shaped member 213 fixed to its forward end. The connecting pin 207 is connected between the free ends of the member 213 in parallel with the horizontal pin 211. The base end of an auxiliary cylinder 215 and the free end of its piston rod 216 are pivotally connected by horizontal pins between a vertical bracket 214 fixed to the top end of the member 208 and the forward end of the cylinder 210. By the extension and retraction of the rod 216 of the auxiliary cylinder 215, the temporarily connecting cylinder 210 is pivotally moved between a substantially horizontal position and an inclined position wherein the rod 212 is at a slightly higher level. A horizontal channel member 218 disposed beneath the forward end of the cylinder 210 in the horizontal position is secured to the side face of the leg 90 at right angles therewith. A pair of stoppers 219 for restraining rotation of the cylinder 210 in a horizontal plane is fixed to the upper side of the channel member 218. A horizontal channel member 220 positioned a small distance above the rod 212 of the cylinder 210 in its horizontal position is fixed to the side of the leg 90 at right angles therewith. A pair of stowing guides 221 disposed at opposite sides of the rod 212 thereabove is fixedly suspended from the bottom side of the channel member 220 and inclined upward outward of the dock. The guides are spaced apart by an increasing distance outward of the dock.

As seen in detail in FIGS. 32 to 37, 45 and 47, a vertical first stowing pin 222 is vertically movably mounted on an upper portion of the side of the leg 90 of the docking truck 6 which leg is closer to the innermost portion of the dock. To a vertical bracket 223 fixed to an upper side portion of the leg 90 is pivoted a vertically downwardly oriented hydraulic cylinder 224 at its upper end by a horizontal pin. Upper and lower two bearings 226, 227 are secured to the side face of the leg 90 immediately below the cylinder 224. An elongated vertical rod 228, which is vertically slidable, is supported by the bearings 226, 227 against rotation. The upper end of the rod 228 is pivoted to the piston rod 229 of the cylinder 229 by a horizontal pin. Oilless liners 231 in contact with the rod 228 are provided in the bearings 226, 227. An arm 232 extending outward of the dock and toward the innermost portion thereof obliquely is fixedly mounted on the rod 228 at a position slightly above the lower bearing 227. A vertical stowing pin support tube 233 is fixed to the free end of the arm 232. The stowing pin has a square cross section and a tapered lower end. At the upper end, the stowing pin 222 is integral with a small-diameter cylindrical portion 234. Fixed to the upper end of this portion 234 is a disklike stopper 235 having a larger outside diameter than the portion 234. A horizontal bottom plate 236 having a thickness smaller than the length of the cylindrical portion 234 is secured to the lower end of the support tube 233. The bottom plate 236 is centrally formed with a circular hole 237 having an inside diameter larger than the outside diameter of the cylindrical portion 234 but smaller than the outside diameter than the stopper 235. The cylindrical portion 234 of the stowing pin 222 is loosely fitted in the circular hole 237 with the stopper 235 resting on the bottom plate 236. Fixed to the side surface of the leg 90 below the lower bearing 227 is a pair of upper and lower guide plates 238, 239 which extends horizontally to a position immediately below the support tube 233. Each of these guide plates 238, 239 is formed with a square guide bore 240 positioned immediately below the circular hole 237 of the support tube bottom plate 236 and slightly larger than the stowing pin 222. By the extension and retraction of the rod 229 of the hydraulic cylinder 224, the stowing pin 222 is vertically moved between a lower limit position wherein the pin 222 extends through the bores 240 of the guide plates 238, 239 and projects downward slightly beyond the lower guide plate 239 and an upper limit position wherein the lower end of the pin 222 is at a slightly lower level than the lower surface of the upper guide plate 238.

As shown in detail in FIGS. 32 to 37, 48 and 49, a vertical second stowing pin 241, which is swivellable and vertically movable, is mounted on an upper side portion of the leg 90 disposed toward the dock inlet. By a horizontal pin, a vertically downwardly oriented hydraulic cylinder 243 is pivoted at its upper end to a vertical bracket 242 secured to an upper side portion of the leg 90. Upper and lower two bearings 245, 246 are fixed to the side face of the leg 90 immediately below the cylinder 243. An elongated vertical rod 247 is supported by the bearings 245, 246 rotatably and vertically movably. The upper end of the rod 247 is pivoted to the lower end of the piston rod 248 of the cylinder 243 by a horizontal pin. Oilless liners 250 in contact with the rod 247 are provided in the bearings 245, 246. A lever support 251 similar to the upper bearing 245 is fixedly provided below and in parallel with the bearing 245. The rod 247 loosely extends through the lever support 251. The portion of the rod 247 which vertically moves inside the upper bearing 245 and the lever support 251 is partly cut away at opposite sides to form flat surfaces 252 parallel to each other and to serve as a lever attaching portion 253. Disposed between the upper bearing 245 and the lever support 251 is a lever 254 having one end, to which the lever attaching portion 253 is connected vertically movably but nonrotatably. A hydraulic cylinder 255 disposed horizontally is pivoted at its base end to a horizontal bracket 256 fixed to the side surface of the leg 90, by a vertical pin. The piston rod 257 of the hydraulic cylinder 255 has a forward end which is pivoted to the other end of the lever 254 by a vertical pin. Oilless liners 258 in contact with the flat surfaces 252 of the rod are fixedly provided inside the lever support 251. Between the bearing 245 and the lever support 251, the lever 254 is also fixedly provided with oilless liners 259 on its upper and lower sides. An arm 260 extending outwardly of the dock is fixed to the rod 247 at a location slightly above the lower bearing 246. The stowing pin 241 is fixed to the forward end of the arm 260. The stowing pin 241 has a square cross section and a tapered lower end. By the extension and retraction of the swivelling hydraulic cylinder rod 257, the arm 260 is swivelled between a position wherein the arm 260 extends obliquely toward the dock inlet and a position wherein the arm extends straight outwardly of the dock, with the result that the stowing pin 241 is revolved between a retracted position inward from the dock side wall 2 and an advanced position outward of the side wall 2. Further the stroke of the rod of the lifting hydraulic cylinder 243 moves the pin 241 vertically over a predetermined range.

As shown in detail in FIGS. 32 to 37 and 50, stowing blocks 261, 252 are attached to the bottom of the legs 90 of the docking truck 6. The bottom side of each of these blocks 261, 262 is cylindrical as centered about a horizontal axis parallel to the dock side wall 2. The leg 90 toward the dock inlet extends downward slightly longer than the other leg 90. The bottom of the inner block 261 is at a slightly higher level than the bottom of the outer block 262 toward the dock inlet. In corresponding relation to the pair of legs 90 of the docking truck 6, a pair of stowing bases 263, 264 is provided at a lower portion of the side wall 2 toward the innermost portion of the dock. The inner base 263 is slightly higher than the base 264 closer to the inlet (see FIG. 5). Stowing blocks 265, 266 corresponding to the blocks 261, 262 of the truck 6 are mounted on the top of the bases 263, 264, respectively. A small distance inward from the inner base 263 longitudinally of the dock, a first stowing bracket 267 extending horizonally widthwise inward of the dock is fixed to an upper portion of the side wall 2. The bracket 267 is formed with square connecting bore 268 slightly larger than the first stowing pin 222 (see FIG. 47). A cavity 269 is formed in an upper portion of the side wall 2 a small distance away from the inner stowing base 264 toward the dock inlet. A second stowing bracket 270 projecting horizontally inward of the dock is attached to the wall of the cavity 269 and disposed within the cavity. The bracket 270 has a square connecting bore 271 slightly larger than the second stowing pin 241.

For docking operation, the docking truck 6 is connected to the side of the drive truck 4 which is inward of the block as will be described below (see FIGS. 8 to 10, 32 and 38). The upper and lower connecting plates 165, 166 of the truck 6 are positioned immediately above the upper and lower connecting plates 62, 63 of the drive truck 4, the upper and lower connecting bores 167 of the truck 6 immediately above the upper and lower pin guides 65 of the truck 4, and the lifting pins 193 of the tuck 6 immediately above the pin bearing surfaces 98 of the connecting blocks of the truck 4, with the connecting surfaces 170 of the truck 6 in pressing contact with the connecting surfaces 74 of the truck 4, whereby the truck 6 is supported by the truck 4 against gravity. With the lifting pins 193 shifted upward at this time, there is a small clearance between the pins 193 and the pin bearing surfaces 98 of the truck 4. Further there is a small clearance between the liner fixing plate 272 under each lower connecting plate 166 of the docking truck 6 and the flange 273 of the pin guide 65 of each lower connecting plate 63 of the drive truck 4. Each connecting pin 183 extends through the upper and lower connecting bores 167 of the truck 6 and the guides 65 of the truck 4 and is in its lower limit position. The horizontal movement of the two trucks 4, 6 relative to each other is prevented by the connecting pin 183. The slanting faces 196 of the connecting blocks 195 of the truck 6 are positioned close to the slanting faces 68 of the connecting blocks 67 of the truck 4 with a small clearance formed between the opposed faces 68 and 196. By the contact of these slanting faces 68 and 196 with each other, the two trucks 4, 6 are prevented from twisting relative to each other in a horizontal plane. Since the reaction to the relative twist of the two trucks 4, 6 is withstood by the slanting faces 68, 196 of the blocks 67, 195, a great twisting force will not act on the connecting pin 183, which therefore need not be made particularly large.

Further at this time, each temporarily connecting cylinder 210 on the truck 6 is in its upwardly inclined position, and the rod 212 is in its retracted position, with the U-shaped member 213 stowed between the guides 221. The first stowing pin 222 is in its upper limit position, while the second stowing pin 241 is in its swivelled retracted position as raised to the upper limit position. The center of the horizontal pin 102 at the base end of the suction disk arm 101 of the truck 6 connected to the truck 4 is approximately at the same level as the horizontal wheels 35, 36 of the drive truck 4 (see FIG. 8).

The drive truck 4, the surface treating truck 5 connected thereto at all times and the docking truck 6 thus connected to the truck 4 are driven along the upper and lower tracks 8, 9 by the drive units 34 on the truck 4. At this time, these trucks 4 to 6 are supported by the vertical wheel rail 22 of the upper track 8 against gravity through the vertical drive wheels 33 on the truck 4 and the vertical driven wheel 71 on the truck 5. Although the trucks 4 to 6 are subjected to a fall moment acting to incline their upper portions inwardly of the dock, the moment is withstood by the horizontal wheel rails 27, 32 of the upper and lower tracks 8, 9 through the horizontal wheels 35, 36, 72 of the truck 4 and the truck 5 and through the horizontal wheels 73, 93 at the lower ends of the legs 70, 90 of the truck 5 and the truck 6. This eliminates the likelihood of the trucks 4 to 6 falling.

When no docking operation is conducted as when surface treatment is performed, the docking truck 6 is separated from the drive truck 4 and stowed on the bases 263 and 264 by the procedure shown in FIGS. 32 to 37.

Figure 32B:
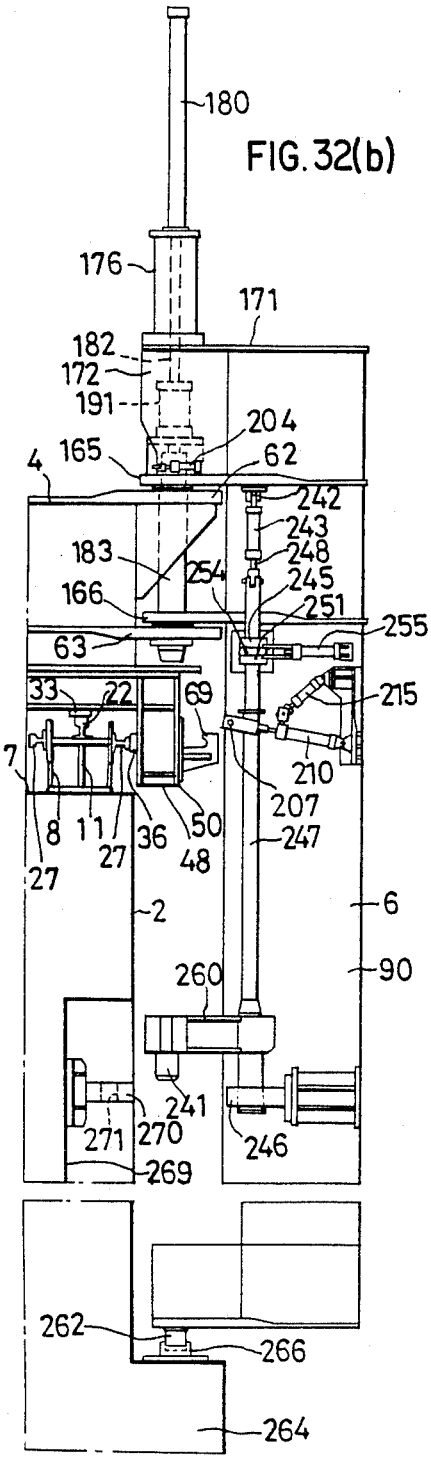
FIGS. 32 to 37 are views showing a procedure stepwise for separating the docking truck from the drive truck and stowing the docking truck on a stowage base, each FIG. (*a*) being a side elevation showing the docking truck as it is seen from the inward side of the dock with an intermediate portion omitted, each FIG. (*b*) being a side elevation showing the docking truck as it is seen from the inlet side of the dock with an intermediate portion omitted.
Figure 32A:
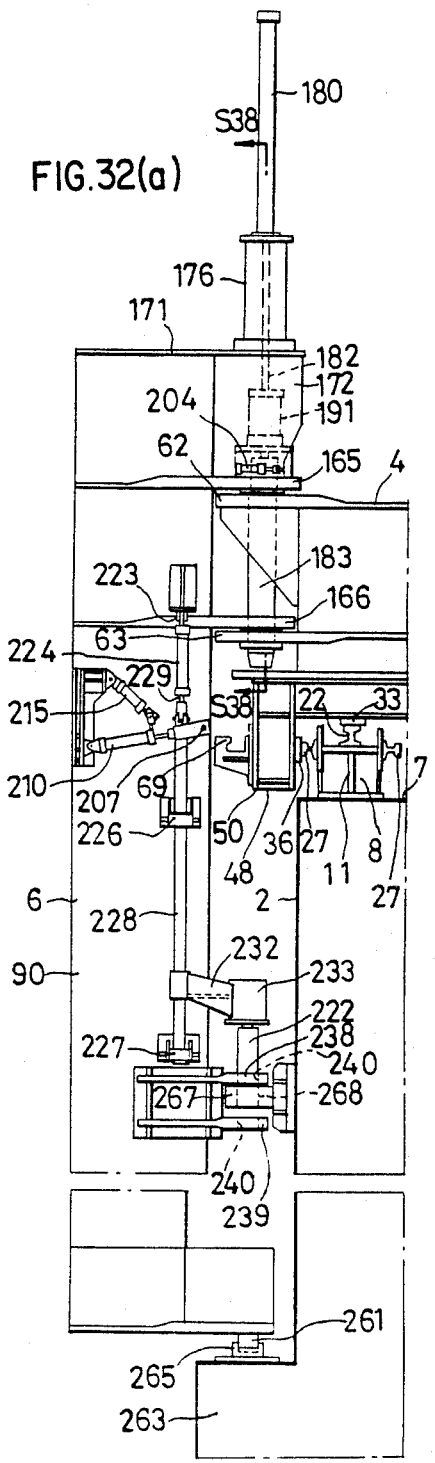
Figure 33B:
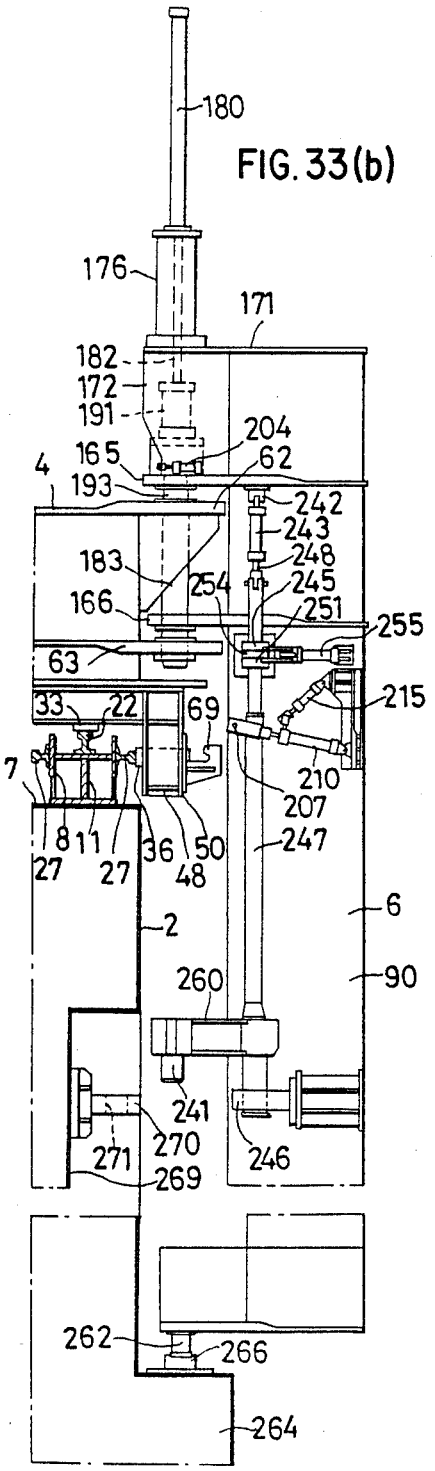
Figure 33A:
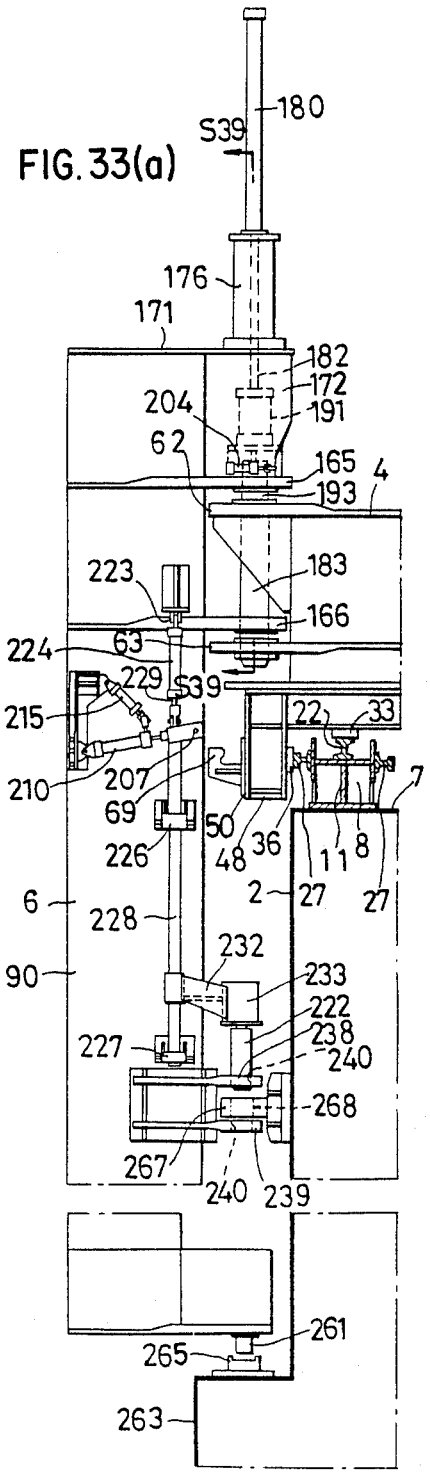

First, the trucks 4, 5, 6 with the truck 6 connected to the truck 4 as above are brought to a stowing preparation position a small distance toward the dock inlet from the outer stowing base 264 (see FIG. 32). At this time, the bottom of the stowing blocks 261, 262 of the truck 6 is about 30 mm below the corresponding blocks 265, 266 on the bases 263, 264.

Next, at the preparation position, the lifting pins 193 of the truck 6 are advanced to their lower limit position relative to the truck 6 (see FIGS. 33 and 39), whereby the lifting pins 193 are brought into pressing contact with the bearing surfaces 98 of the connecting blocks 67 on the truck 4. The truck 6 is raised about 60 mm from its connected position relative to the drive truck 4. This lifts the bottom of the stowing blocks 261, 262 of the truck 6 about 30 mm above the top of the corresponding blocks 265, 266 on the bases 263, 264. In this state, the trucks 4, 5, 6 are moved to a stowed position wherein the blocks 261, 262 are located immediately above the corresponding blocks 265, 266 on the bases 263, 264. This positions the first stowing pin 222 of the truck 6 immediately above the connecting bore 268 of the first stowing bracket 267 on the dock side wall 2, with the upper and lower guide plates 238, 239 for the pin 222 positioned slightly above and immediately below the bracket 267, respectively. Further the second stowing pin 241 of the truck 6 is positioned inwardly of the dock from the cavity 269 in the wall 2, and the lower end of the pin 241 is at a slightly higher level than the second bracket 270 within the cavity 269. When the docking truck 6 is moved to the stowed position, the bottom of the stowing blocks 261, 262 of the truck 6 is above the top of the corresponding blocks 265, 266 on the bases 263, 264, so that there is no likelihood of collision between the blocks. Further since the top of the block 266 on the base 264 toward the dock inlet is lower than the top of the block 265 on the inner base 263, the inner block 261 of the truck 6 will in no way strike against the block 266 closer to the dock inlet. Further because all the stowing blocks 261, 262, 265, 266 are larger than 30 mm in thickness, the blocks 261, 262 merely collide with the blocks 265, 266 if the truck 6 is moved to the stowed position without being lifted. The blocks 265, 266 on the bases 263, 264 are merely held between a pair of vertical plates 274 fixed to the base, widthwise of the dock (see FIG. 50), and thus easily removed from the bases 263, 264 when stuck on by the blocks 261, 262 of the truck 6. Accordingly even when a collision occurs between the blocks 261, 262 and the blocks 265, 266, there is no likelihood of damage to the truck 6 or bases 263, 264. With the second stowing bracket 270 located within the cavity 269 in the dock side wall 2, the first stowing pin 222 or the guides 238, 239 therefor are totally unlikely to collide with the bracket 270 during the movement.

Figure 34B:
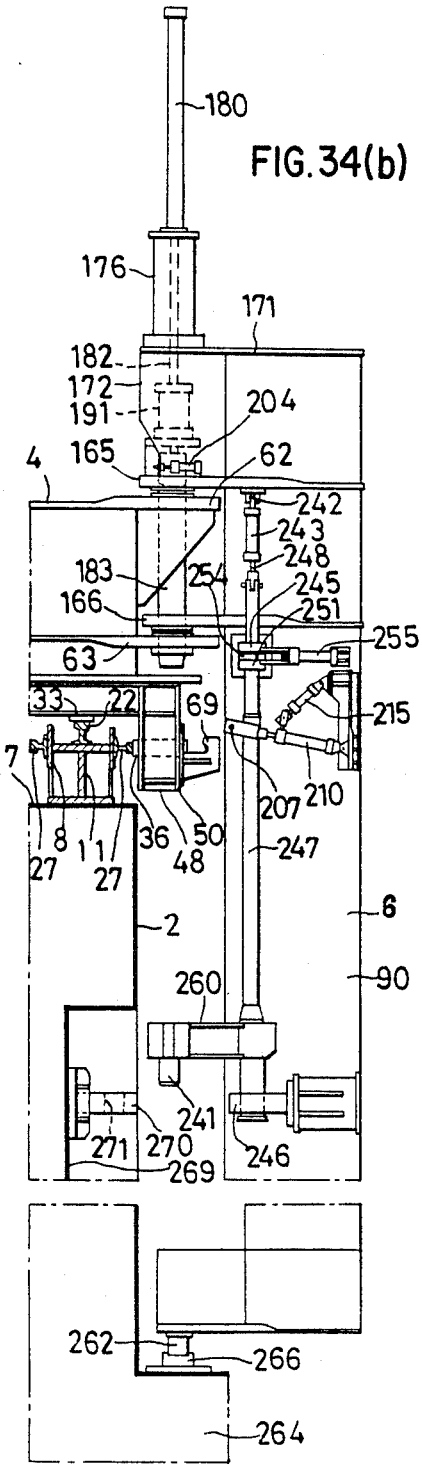
Figure 34A:
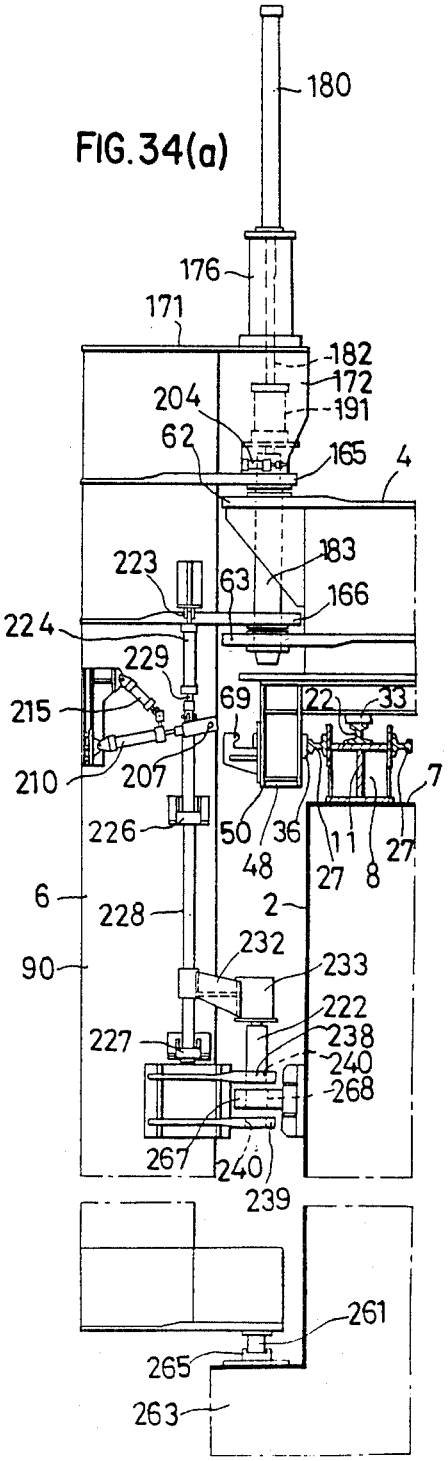
Figure 35B:
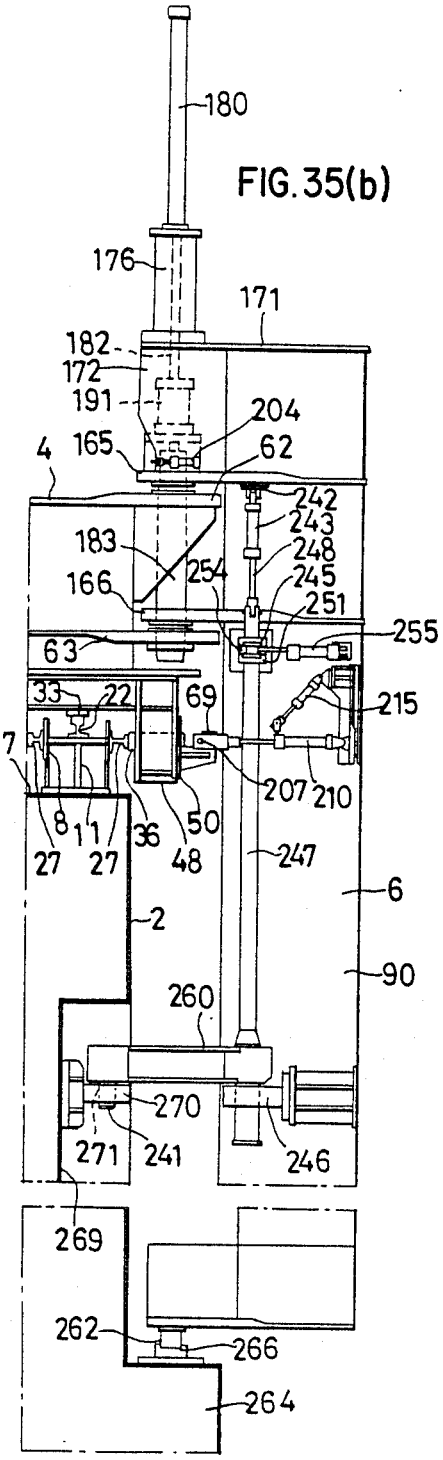
Figure 35A:
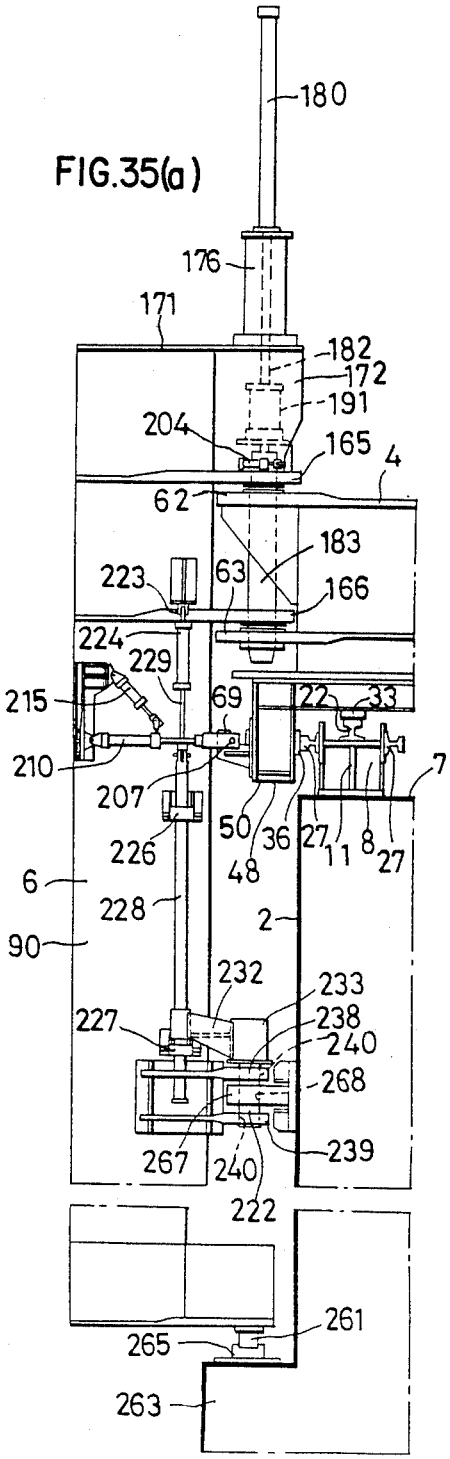
Figure 40A:
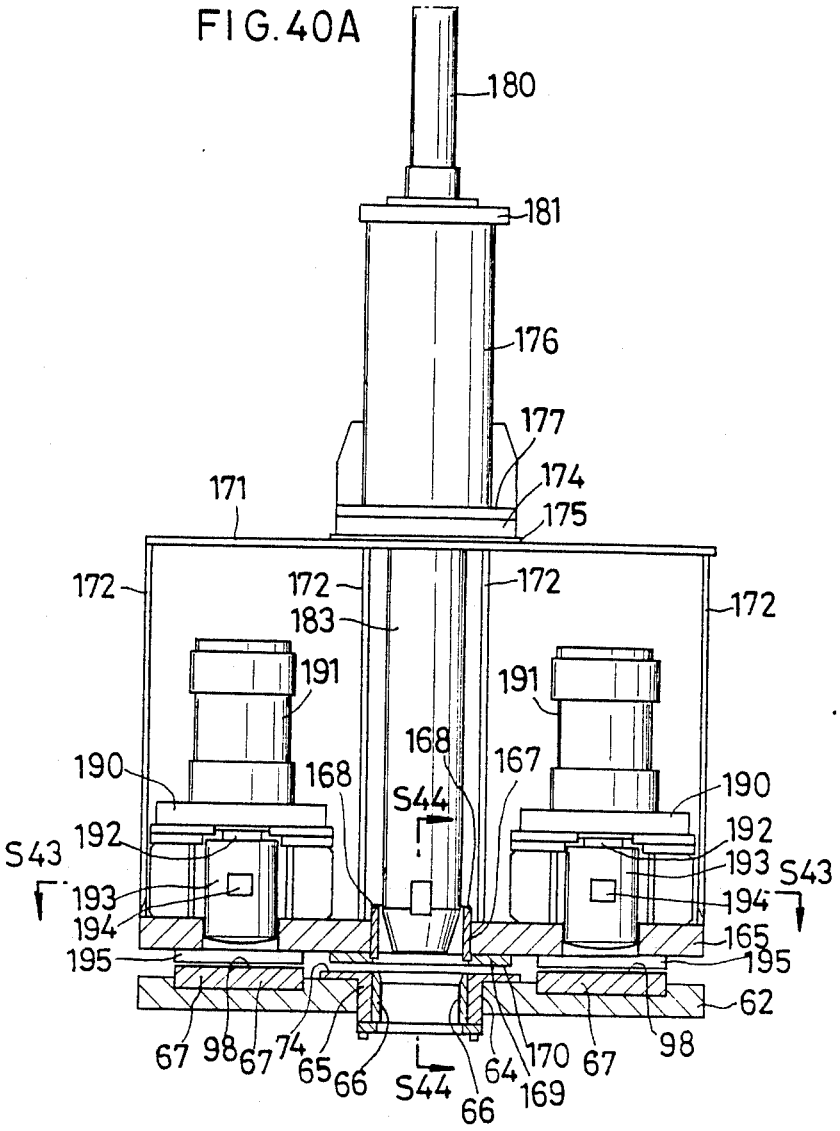
FIG. 40 is an enlarged view in section taken along the line S40—S40 in FIG. 36 (*a*)
Figure 40B:
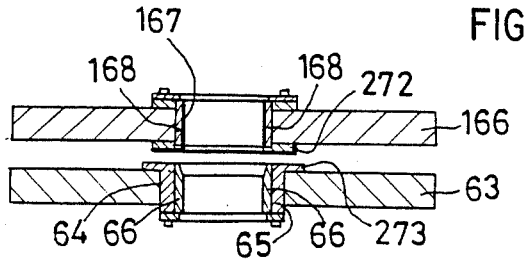
Figure 42:
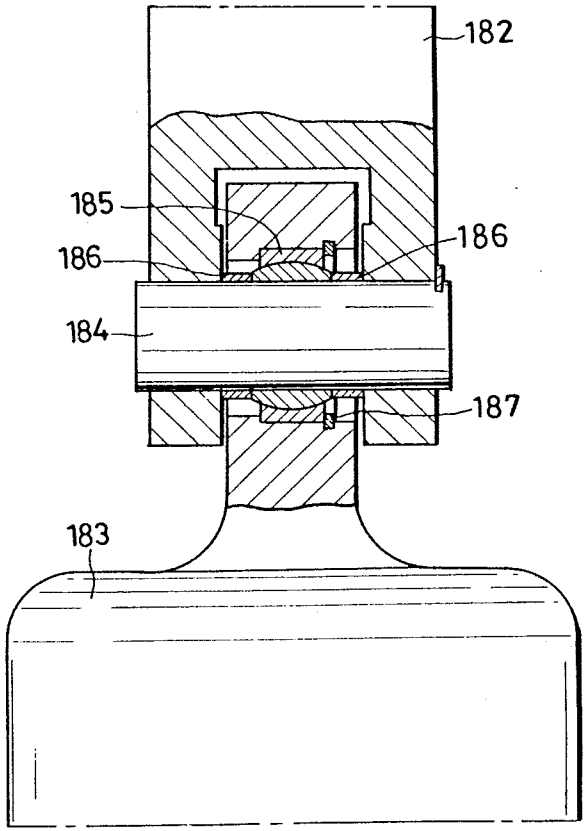
FIG. 42 is an enlarged view in section taken along the line S42—S42 in FIG. 38.

In the stowed position, the lifting pins 193 of the truck 6 are subsequently retracted to their upper limit position (FIGS. 34 and 40). As the pins 193 are retracted, the docking truck 6 is gradually lowered. When the truck is lowered about 30 mm from its lifted position, the stowing blocks 161, 162 of the truck 6 rest on the corresponding blocks 165, 166, whereupon the truck 6 is halted. The lifting pins 193 only are thereafter raised to the upper limit position away from the bearing surfaces 98 of the truck 4. When the truck 6 is stowed on the bases 163, 164 in this way, it is about 30 mm above its connected position, with a clearance of about 30 mm formed between the connecting surfaces 74 and 170 of the trucks 4 and 6.

Figure 47:
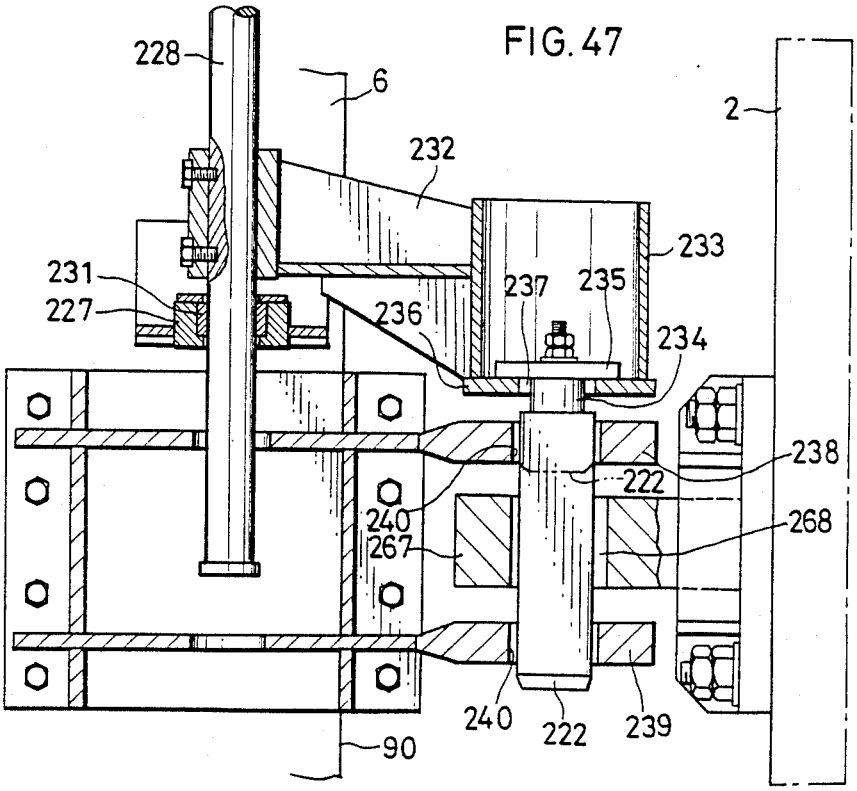
FIG. 47 is an enlarged fragmentary view of FIG. 35 (*a*) partly broken away.
Figure 48:
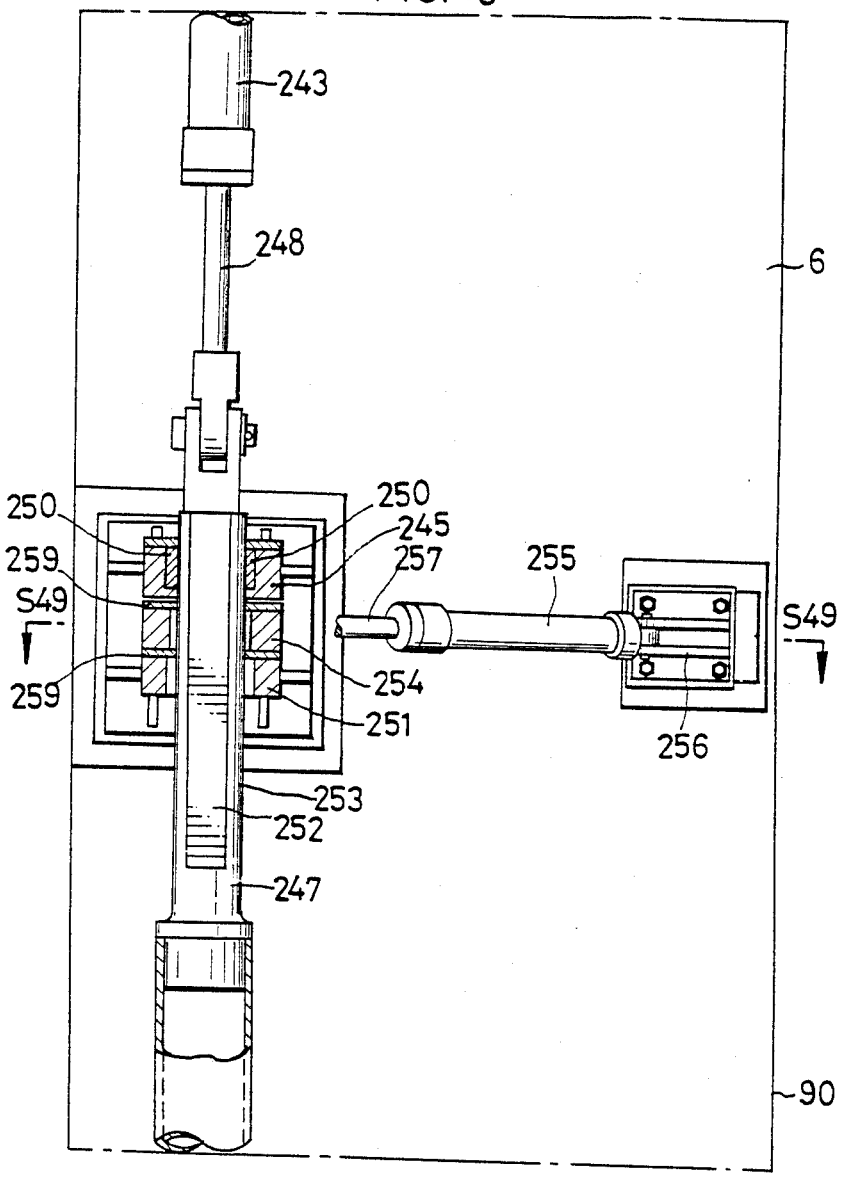
FIG. 48 is an enlarged fragmentary view of FIG. 35 (*b*) partly broken away.
Figure 49:
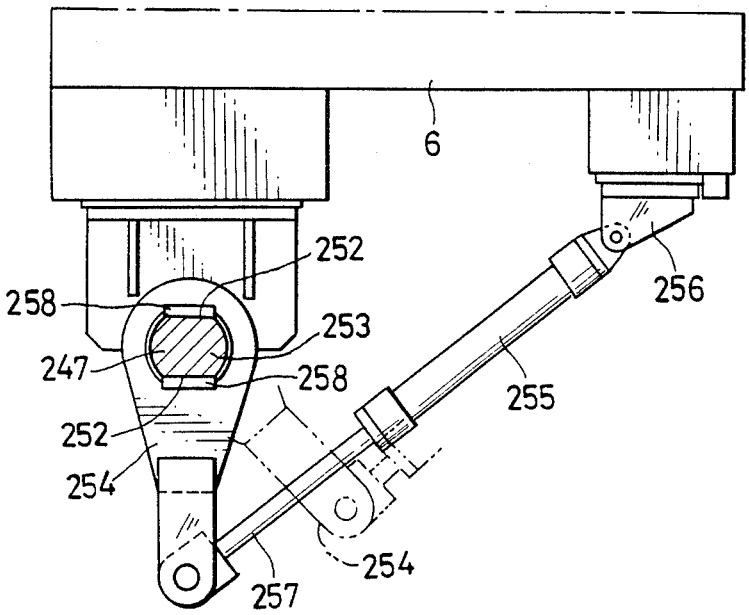
FIG. 49 is a view in section taken along the line S49—S49 in FIG. 48.

Next, the temporarily connecting pins 207 at opposite sides of the docking truck 6 are engaged with the corresponding hooks 69 on the drive truck 4, and the first and second stowing pins 222, 241 are thereafter inserted through the connecting bores 268, 271 of the first and second brackets 267, 270 on the dock side wall 2 (see FIGS. 35 and 45 to 47). The temporarily connecting pin 207 is engaged with the hook 69 in the following manner. First, the rod 212 of the hydraulic cylinder 210 is stretched, whereby the pin 207 accommodated between the guides 221 as indicated in broken line A in FIG. 45 is moved over the hook 69 outward of the dock to a position indicated in broken line B in the same drawing. The cylinder 210 is then turned to its horizontal position as indicated in broken line C, and the rod 212 is thereafter retracted as shown in solid line in the same drawing, bringing the pin 207 into engagement with the hook 69 and slightly drawing the upper portion of the truck 6 toward the truck 4. As a result, the falling moment of the truck 6 which has been withstood by the connecting pin 183 is received by the pin 207 and hook 69. To avoid complete fitting engagement of the pin 207 with the hook 69, the outside diameter of the pin 207 is made smaller than the diameter of the circular arc of the engaging portion of the hook 69. The first stowing pin 222 can be inserted through the first bracket connecting bore 268 by lowering the pin support tube 233 to its lower limit position. FIG. 47 shows the pin 222 in its lower limit position, wherein the pin extends through the guide bore 240 of the upper guide plate 238, connecting bore 268 of the bracket 267 and the guide bore 240 of the lower guide plate 239 to connect these members together. The second stowing pin 241 is inserted through the bore 271 in the following manner. First, the arm 260 of the pin 241 is swivelled to the advanced position, whereby the pin 241 is placed into the cavity 269 in the dock side wall 2 and stopped in alignment with the bore 271 in the second bracket 270 thereabove. The pin 241 is then lowered to its lower limit position and thereby inserted into the connecting bore 271.

Figure 36B:
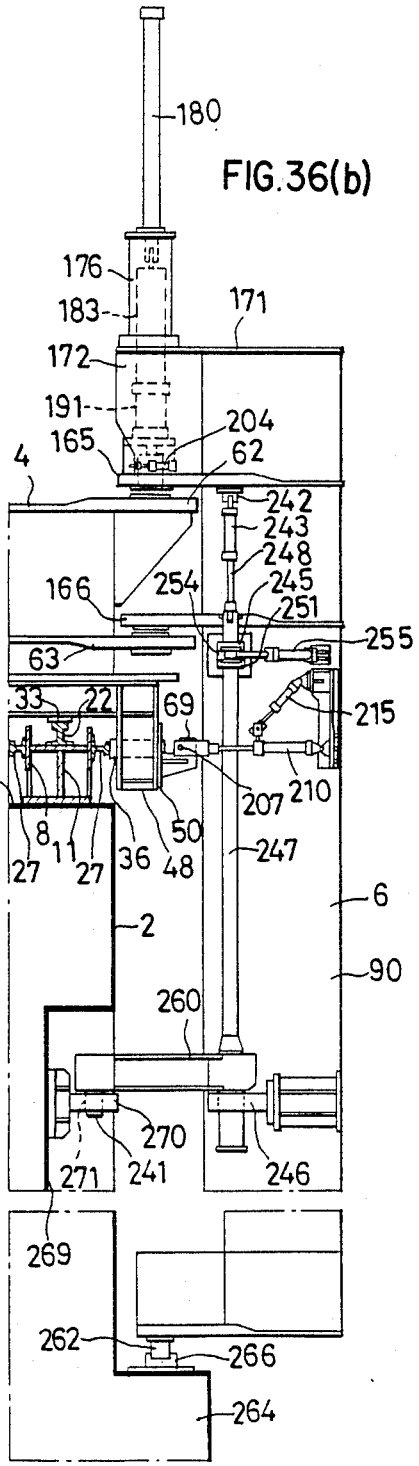
Figure 36A:
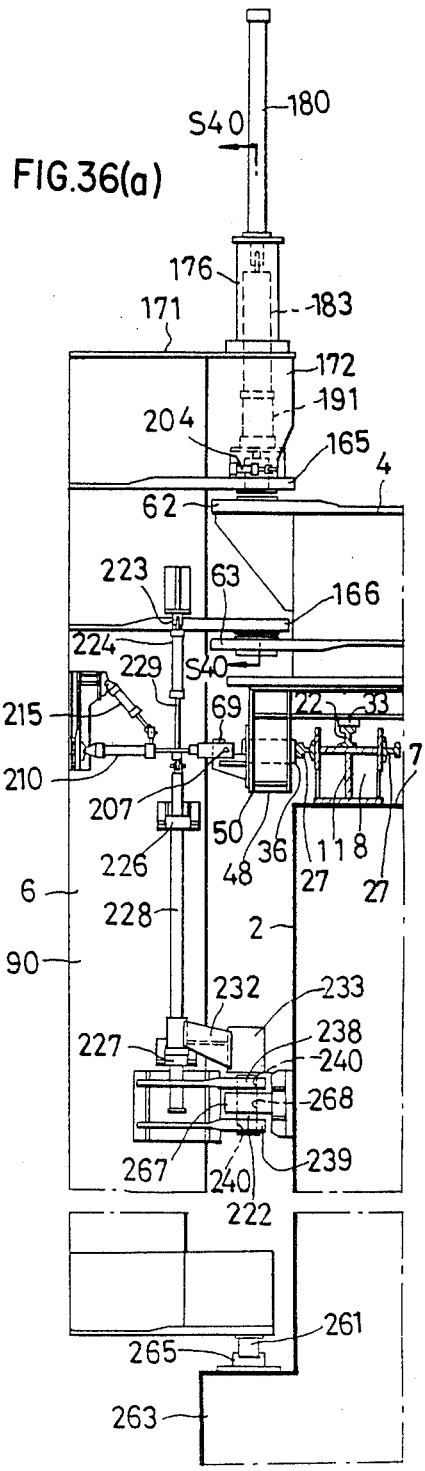
Figure 37B:
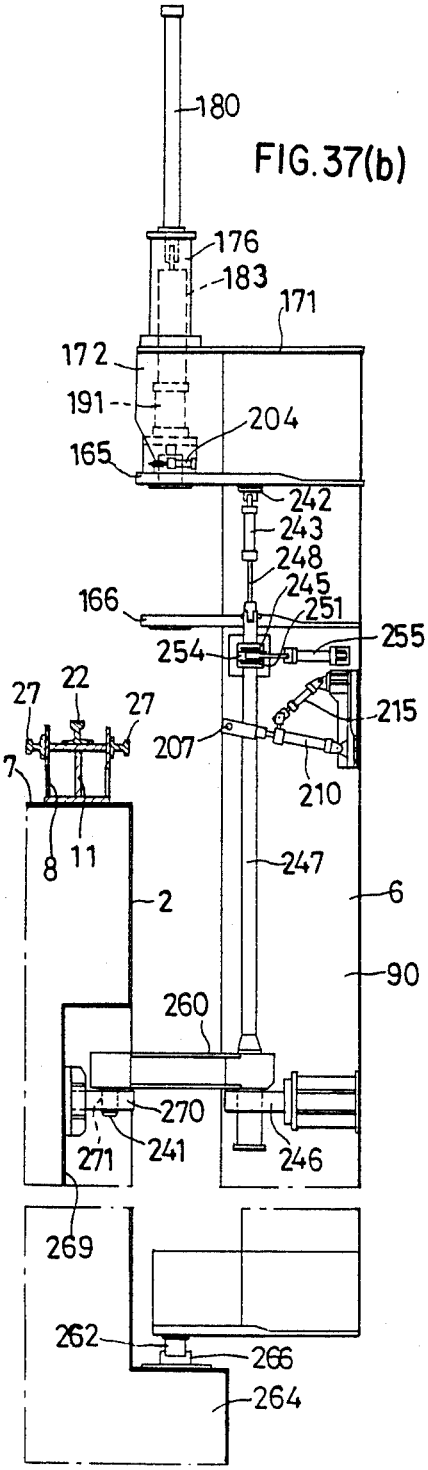
Figure 37A:
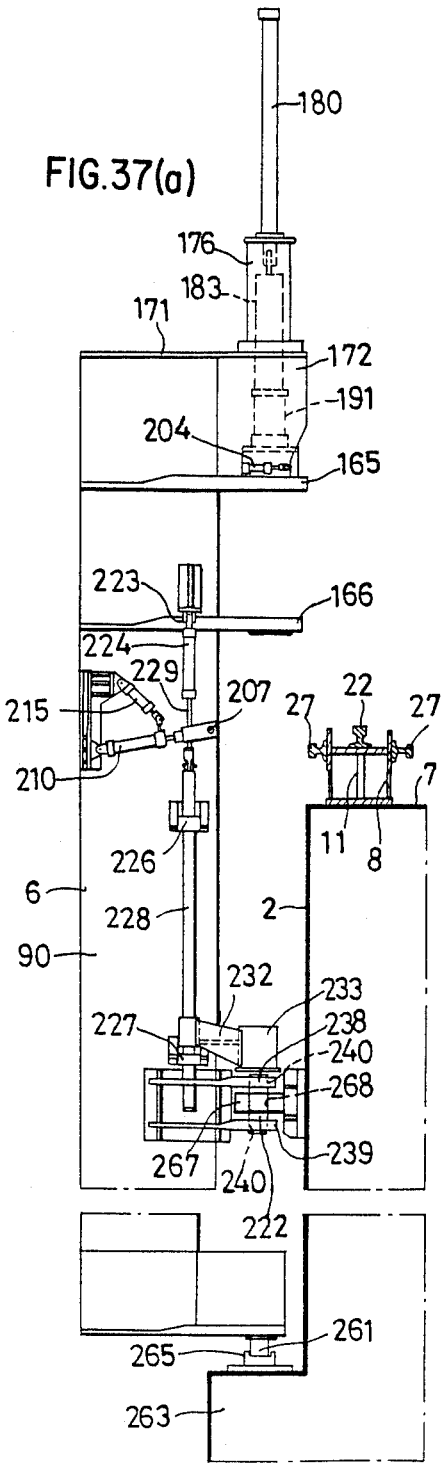
Figure 38:
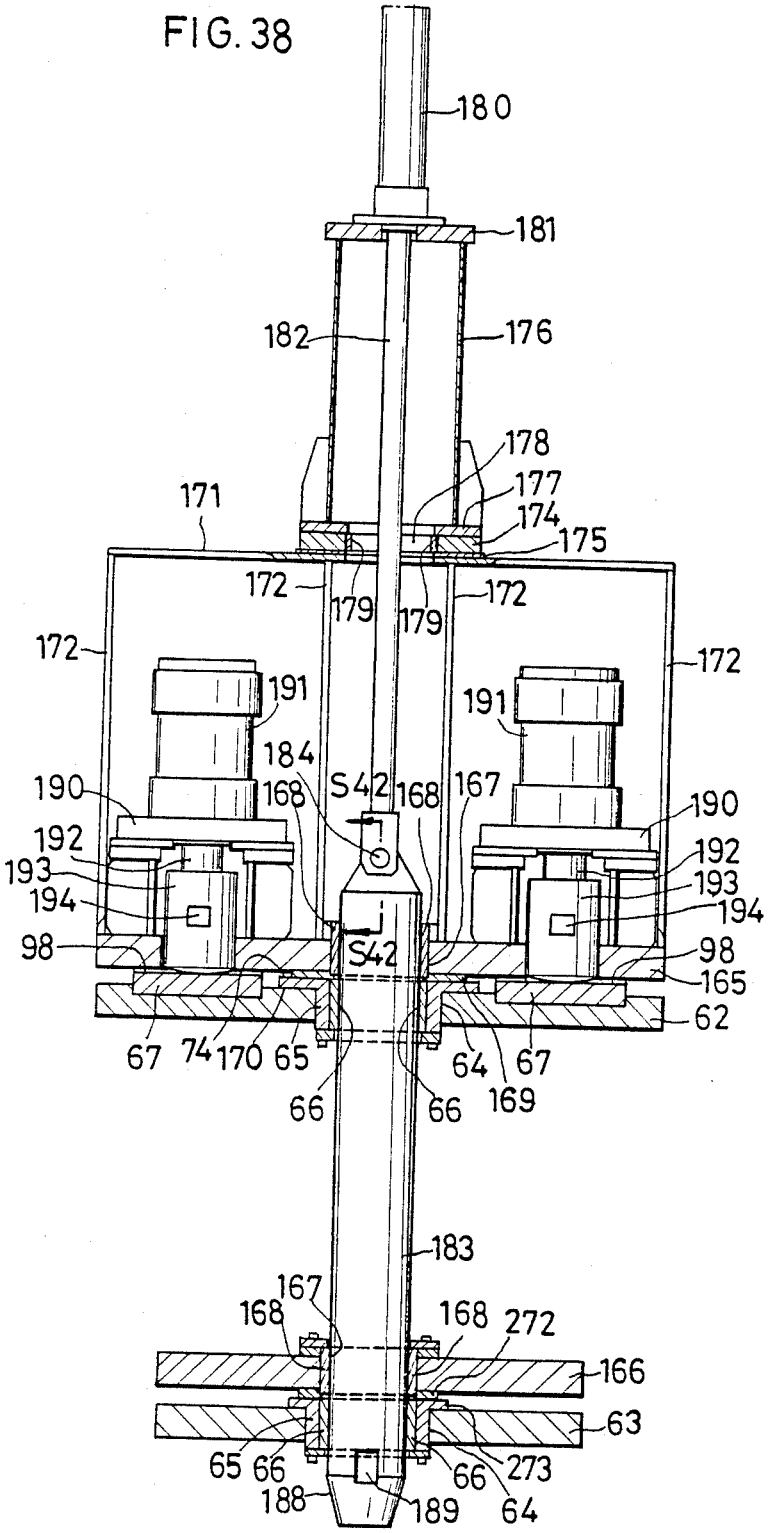
FIG. 38 is an enlarged view in section taken along the line S38—S38 in FIG. 32 (*a*)
Figure 39:
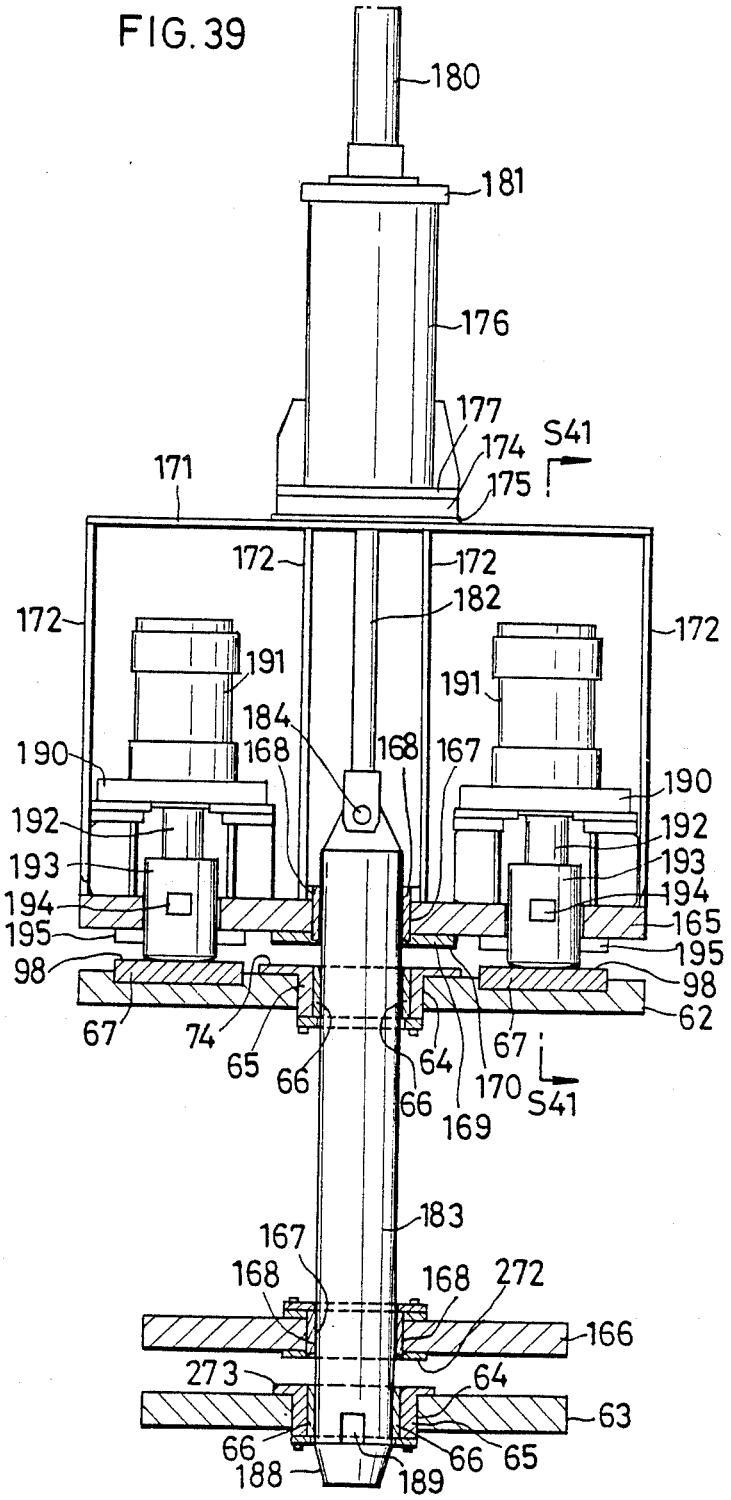
FIG. 39 is an enlarged view in section taken along the line S39—S39 in FIG. 33 (*a*)

Subsequently each connecting pin 183 of the truck 6 is raised to its upper limit position and thereby upwardly withdrawn from the upper and lower guides 65 of the truck 4 and the upper and lower connecting bores 167 of the truck 6 (see FIGS. 36 and 43). At this time, the falling moment of the docking truck 6 is withstood or borne by the temporarily connecting pin 207 and hook 69, and the guides 65 and the connecting bores 167 are internally provided with oilless liners 66, 168, so that the connecting pin 183 is smoothly withdrawable. Although the stowing pins 222, 241 of the truck 6 are loosely inserted through the stowing brackets 267, 270 on the dock side wall 2 with a small clearance left in the bores 268, 271, the connecting pin 183 is pulled out with the falling moment of the truck 6 borne by the pin 207 and the hook 69, with the result that no impact will act between the pins 222, 241 and the brackets 267, 270 upon the withdrawal of the connecting pin 183 from the guides 65 and the connecting bores 167. After the connecting pin 183 is raised to its upper limit position, the fall preventing plate 201 of the assembly 197 is moved inward of the dock, fitting the projections 203 on the plate 201 into the cavities 189, 194 of the connecting pin 183 and the lifting pins 193 which have been raised to the upper limit position (FIG. 43 and FIG. 44). This effectively prevents the fall of the connecting pin 183 and the lifting pins 193, especially of the heavy pin 183, that could occur if the hydraulic cylinders 180, 191 should develop an internal leak.

Next, the temporarily connecting pin 207 is disengaged from the hook 69 and stowed in the space between the guides 221 by a procedure reverse to the above. Finally, the drive truck 4 and the surface treating truck 5 are moved toward the dock inlet (see FIG. 37). As the rod 212 of the hydraulic cylinder 210 in the horizontal position is gradually extended, the upper portion of the truck 6 slightly inclines inwardly of the dock, permitting the stowing pins 222, 241 and the brackets 267, 270 to bear the falling moment of the truck 6 in the meantime. The connecting pin 207 is then brought to the broken-line position C, thereafter to the position B and finally to the position A shown in FIG. 45 for stowing. Since the bottom surfaces of the stowing blocks 261, 262 of the truck 6 are cylindrical, these portions are smoothly movable when the truck 6 inclines. After the temporarily connecting pin 207 has been released, the falling moment of the docking truck 6 is borne by the first bracket 267 via the upper and lower guide plates 238, 239 for the first stowing pin 222 and the pin 222 and also by the second bracket 270 by way of the rod 247 for the second stowing pin 241, the arm 260 and the second stowing pin 241. To prevent the rod 228 for the first stowing pin 222, arm 232, etc. from bearing the falling moment of the truck 6, the clearance around the cylindrical portion 234 of the pin 222 in the bore 237 of the support tube bottom plate 236 and the clearances around the pin 222 in the guide bore 240 of the guide plate 238 and in the connecting bore 268 of the first bracket 267 are suitably determined. After the truck 6 has been stowed on the bases 263, 264 in this way, the trucks 4 and 6 are free from connection or interference with each other. The drive truck 4 and the surface treating truck 5 are now movable toward the dock inlet as separated from the docking truck 6.

The drive truck 4 and the surface treating truck 5 separated from the docking truck 6 are driven along the upper and lower tracks 8, 9 by the drive units 34 on the truck 4. During running, the falling moment of the truck 5 is borne by the horizontal wheel rails 27, 32 of the upper and lower tracks 8, 9 by way of the horizontal wheels 72 and the horizontal wheels 73 at the lower end of the leg 70. Although the drive truck 4 is merely placed on the upper track 8 by the vertical drive wheels 33 and the horizontal wheels 35, 36, the connection between the trucks 4 and 5 is so constructed that the trucks are not allowed to twist relative to each other about an axis in parallel with the upper track 8 as already stated, so that the falling moment of the drive truck 4 is borne by the truck 5 without likelihood of the drive truck 4 falling. Although having the elongated jib 78, the surface treating truck 5 itself is elongated and has connected to its one end the elongated drive truck 4 at all times, hence very good stability. Because the load of the trucks 4 and 5 is supported by the vertical drive wheels 33 and the driven vertical wheel 71 at three locations, the trucks 4, 5 are less susceptible to deflection. The upper track 8, which should preferably be completely linear, inevitably becomes somewhat undulated in a vertical plane and in a horizontal plane. However, the drive truck 4 and the surface treating truck 5 are so connected as to be rotatable about the horizontal pin, as well as about the vertical pin 84, relative to each other, with the result that the vertical wheels 33, 71 at the three locations and the horizontal wheels 35, 36, 72 are always in contact with the rails 22, 27 of the upper track 8 which may be zigzag. If it is assumed that the trucks 4, 5 are connected together without being allowed to rotate relative to each other, it is impossible for the wheels at three locations to be in contact with the rails 22, 27 at all times if the upper track 8 is zigzag. This problem is avoidable when the wheels are provided at two locations, but the distance between the points where the elongated truck assembly is supported (distance between vertical wheels) then becomes large. This results in such structurally objectionable problem that the truck assembly undergoes increased deflection. Because the drive wheels 33 on the drive truck 4 bear about one half of the weight of the surface treating truck 5, the drive wheels 33 thus heavily loaded afford an increased drive force. With each drive unit 34 of the drive truck 4, the two drive wheels 33 are individually connected to the hydraulic motors 41 and are further coupled to each other by an idle gear 40, consequently giving their drive forces in good balance and eliminating the likelihood that one of the drive wheels 33 will be overloaded owing to corrosion of the wheel or irregularities on the rail 22.

The docking truck 6 on the stowing bases 263, 264 on the deck side wall 2 may be connected to the drive truck 4 again by a procedure reverse to the foregoing as will be described below.

First, the drive truck 4 and the surface treating truck 5 are brought to the stowed position to locate the upper and lower connecting pin guides 65 of the drive truck 4 below the upper and lower connecting bores 167 of the docking truck 6 generally in alignment therewith, and the temporarily connecting pins 207 of the docking truck 6 are then engaged with the hooks 69 on the truck 4 to slightly pull the upper portion of the truck 6 toward the truck 4. The plate 201 of each fall preventing assembly 197 is then moved outward of the dock to draw out the projections 203 from the cavities 189, 194 of the connecting pin 183 and the lifting pins 193. Each connecting pin 183 is thereafter lowered to its lower limit position and thereby inserted through the upper and lower connecting bores 167 of the truck 6 and the upper and lower guides 65 of the drive truck 4. When the drive truck 4 is merely moved to the stowed position, the guides 65 are slightly out of alignment with the connecting bores of the truck 6 in a direction at right angles with the dock side wall 2, but they can be substantially aligned by slightly pulling the truck 6 toward the truck 4 as stated above. Because the connecting pin 183 is tapered at its lower end as at 188, the drive truck 4 can be moved to the proper position by forcing the tapered end 188 into the connecting bores 167 and the guides 65 even if the trucks 4 and 5 are somewhat improperly positioned longitudinally thereof. Since the length of the pin 207 is much larger than the width of the hook 69, they will not prevent the movement of the truck 4.

Next, the first stowing pin 222 of the truck 6 is raised to its upper limit position and thereby pulled out of the guide bore 240 of the lower guide plate 239 and the connecting bore 268 of the first bracket 267. At the same time, the second stowing pin 241 of the truck 6 is raised to its upper limit position and thereby pulled out from the bore 271 of the second bracket 270 on the deck side wall 2. The pin 241 is then turned to its retracted position.

Subsequently each pin 207 is disengaged from the hook 69 and stowed between the guides 221, and the lifting pins 193 on the truck 6 are advanced to their lower limit position. This lifts the truck 6 about 60 mm from its connected position relative to the truck 4, raising the stowing blocks 261, 262 on the truck 6 about 30 mm upward away from the blocks 265, 266 on the bases 263, 264.

With the truck 6 in its lifted position, the truck 4 and the truck 5 are moved to the stowing preparation position. Finally the lifting pins 193 on the truck 6 are retracted upward to lower the truck 6 and bring the connectings surfaces 170 of the truck 6 into contact with the connecting surfaces 74 of the truck 4.

Another docking apparatus 3 positioned toward the dock inlet is similarly mounted on the same upper and lower tracks 8 and 9 as above, and another pair of stowing bases 263, 264, etc. are similarly provided on the side wall 2 as positioned toward the dock inlet.

The docking apparatus 3, the stowing bases 263, 264, etc. toward the dock inlet are symmetric with the docking apparatus 3, the stowing bases 263, 264, etc. toward the inner most portion of the dock with respect to a vertical plane at right angles with the dock side wall 2. Further the docking apparatus 3, the stowing bases 263, 264, etc. on one side wall 2 of the dock is symmetrical with those on the other side wall 2 with respect to a central vertical plane of the dock 1 in parallel with the side walls 2. With each docking apparatus 3, the docking truck 6 is stowed and connected in the same manner as above.

Figure 51:
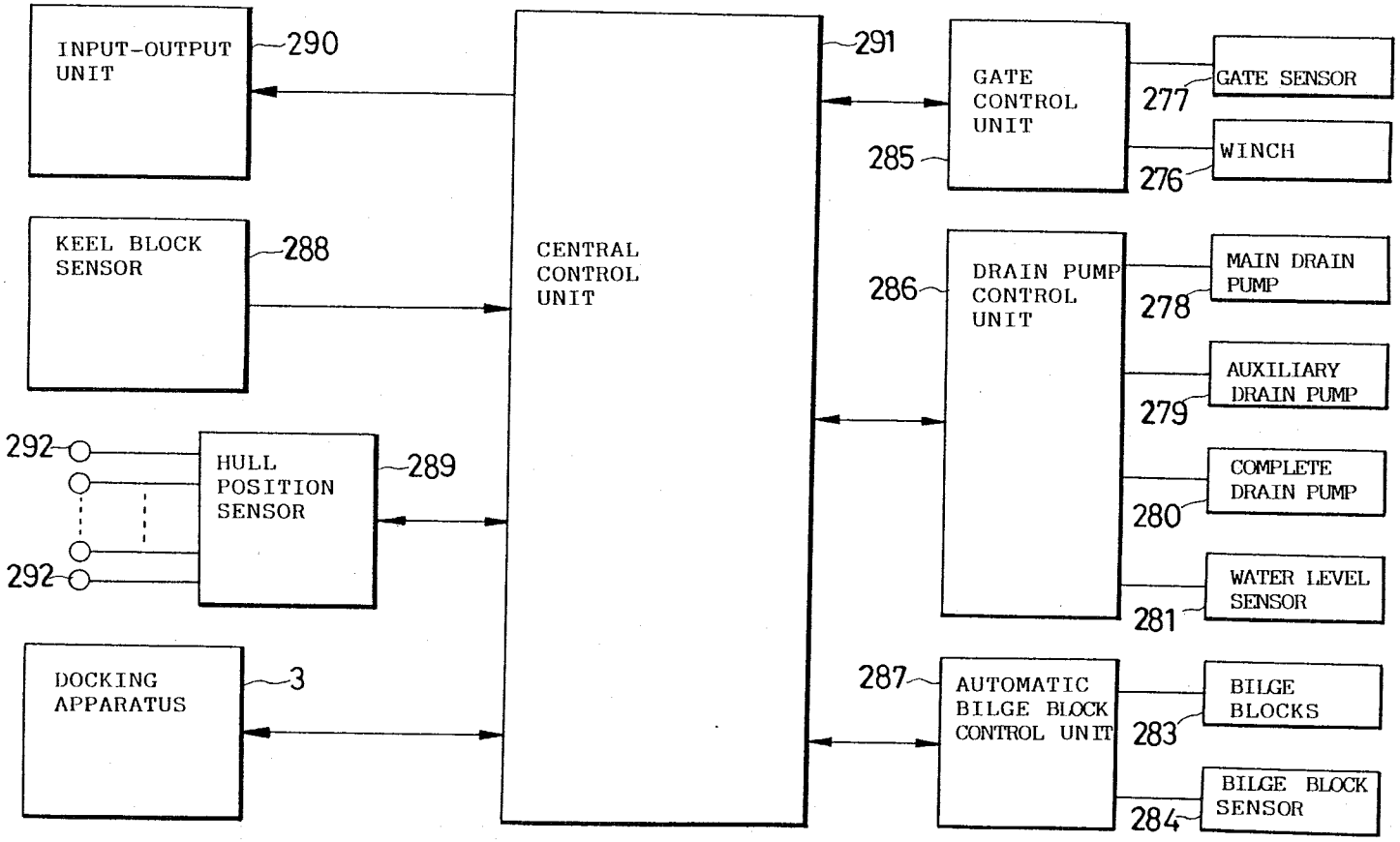
FIG. 51 is a block diagram showing a system for automatically installing a docked ship.

The dock 1 is provided with the following equipment and system for automatically installing a docked ship (see FIG. 51).

Stated more specifically, the dock 1 has a winch 276 for opening or closing its gate 275, a gate sensor 277 for detecting the opening or closing of the gate 275, two main drain pumps 278, two auxiliary drain pumps 279, a complete drain pump 280, a water level sensor 281, etc. On the bottom of the dock 282, there are a plurality of keel blocks at the center thereof and a plurality of bilge blocks 283 to be arranged at opposite sides of the keel blocks. The bilge blocks 283 are provided with a bilge block sensor 284 for detecting the contact of the block with the bilge.

The automatic installation system is provided, in addition to the docking apparatus 3, with a gate control unit 285, drain pump control unit 286, automatic bilge block control unit 287, keel block sensor 288, hull position sensor 289, input-output unit 290, central control unit 291, etc.

The gate control unit 285 controls the winch 276 for opening or closing the gate 275. The output of the gate sensor 277 is fed to the control unit 285.

The drain pump control unit 286 controls the main drain pumps 278, the auxiliary drain pumps 279 and the complete drain pump 280. The output of the water level sensor 281 is fed to the control unit 286.

The automatic bilge block control unit 287 is adapted to automatically place the bilge blocks 283 beneath the bilge. The output from the sensor 284 is fed to the control unit 287.

The keel bilge block sensor 288 detects the contact of the bottom of the ship with the keel block and feeds an output to the central control unit 291.

The hull position sensor 289 is adapted to detect the position of the hull within the dock 1, i.e., the position of the hull longitudinally thereof, as well as widthwise thereof, deviation of the hull in a horizontal plane, distance between the bottom of the ship and the keel blocks, longitudinal inclination (trim) of the hull in a vertical plane and widthwise inclination (heel) of the hull. The sensor 289 includes a plurality of sensor members 292 and feeds an output to the central control unit 291.

The input-output unit 290 is adapted to feed to the central control unit 291 data necessary for automatic installation control and has a keyboard, CRT, etc.

The central contol unit 291 controls the overall automatic installation system and comprises an inputoutput circuit for the transmission of signals with the other components, control circuit and data processing means for processing the data collected.

A ship 293 is hauled into the dock by the docking apparatus 3 each with its docking truck 6 connected to the drive unit 4 as already stated, in the following manner (see FIG. 1 (*a*)).

Figure 8:
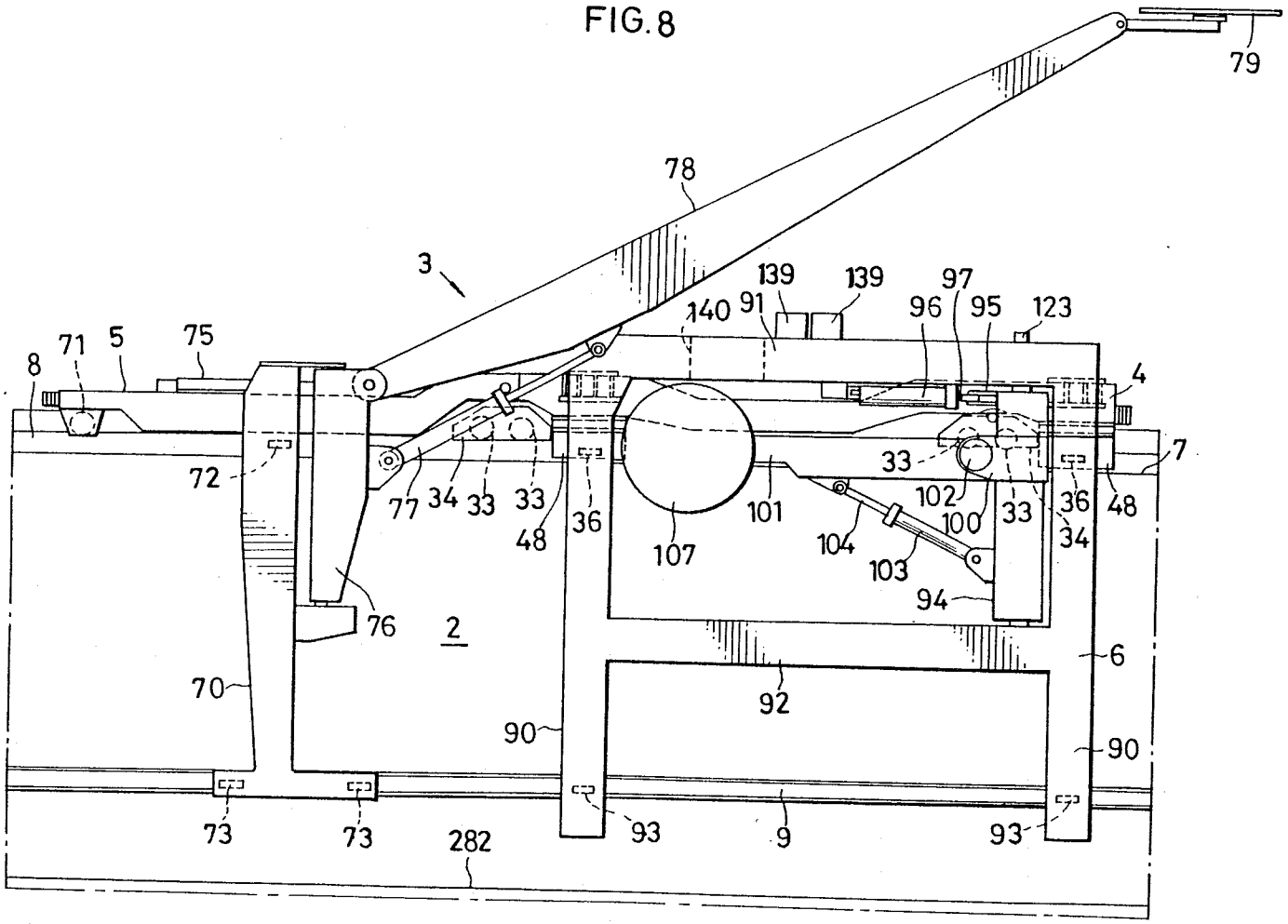
FIG. 8 is a front view showing the docking apparatus with its drive truck and the docking truck connected together.
Figure 9:
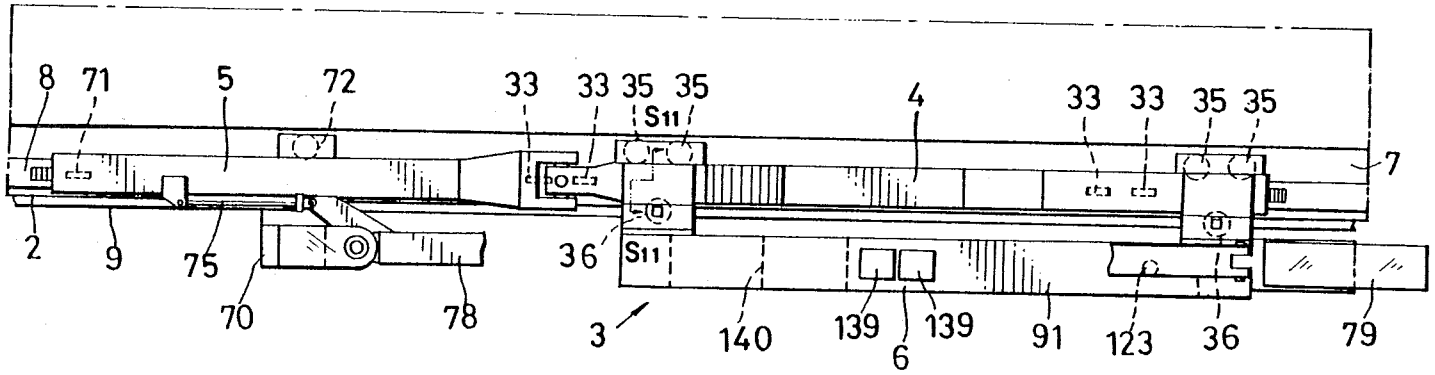
FIG. 9 is a plan view partly broken away and showing the same.

With use of a tugboat (not shown), the ship 293 is guided to the inlet of the dock and the bow is led into the dock 1. At this time, the four docking apparatus 3 on opposite side walls 2 of the dock are positioned in the vicinity of the dock inlet, and the suction disk arm 101 of each docking truck 6 is held retracted in the space between the horizontal portions 91, 92 substantially in a horizontal position as seen in FIG. 8. After the bow of the ship 293 has been placed into the dock 1 to some extent, the arms 101 of the two docking apparatus 3 closer to the innermost portion of the dock are pivotally moved inward to bring the suction disks 107 toward the ship 293, and the inclination of the disks 107 is suitably adjusted to cause the disks 107 to attract the side plates of the hull at the bow. With the bow thus held attracted to the suction disk, the ship is moved inward of the dock by the two inward docking apparatus 3, i.e. the drive trucks 4, the surface treating trucks 5 and the docking trucks 6, which are driven inward, while the position of the ship 293 is being adjusted by the tugboat. After a major portion of the ship 293 has been hauled into the dock 1, the side plates of the hull are similarly attracted at the stern by the suction disks 107 of two docking apparatus 3 closer to the dock inlet. The four docking apparatus 3 are moved inward to further haul the ship 293 into the dock 1. When the ship 293 has been pulled to a specified position, the four docking apparatus 3 are halted, and the ship is braked and stopped by the tugboat tied to the stern. The suction disk arms 101 of the apparatus 3 are suitably swivelled to position the ship 293 widthwise thereof. The tugboat is then separated from the ship 293 and brought out of the dock 1. On the other hand, the items of data required for the installation of the ship, such as the length, width, draft and the position of installation of the ship, are entered from the input-output unit 290 in the central control unit 291 of the automatic installation system. After the ship 293 has been hauled into the dock 1 as specified, the operator gives an instruction for the start of installation via the input-output unit 290. In response to the instruction, the system operates to automatically install the ship on the keel blocks and bilge blocks 283 at the bottom 282 of the dock 1 in the following manner. During this procedure, the central control unit 291 always monitors the position of the ship 293 detected by the hull sensor 289 and controls the docking apparatus 3 to hold the ship 293 in position at all times while monitoring and controlling the units 285, 286 and 287.

In response to the start instruction from the input-output unit 290, the central control unit 291 feeds a gate closing instruction signal to the gate control unit 285, which in turn controls the winch 276 to close the gate 275. Upon the sensor 277 detecting that the gate 275 has been completely closed, the gate control unit 285 sends a gate closing completion signal to the central control unit 291.

In response to this signal, the central control unit 291 gives a drain instruction signal to the drain pump control unit 286 for the start of drainage. In response to this signal, the unit 286 initiates the two main drain pumps 278 into operation first to drain the dock 1 at a full speed. This gradually lowers the water level within the dock 1, thereby gradually lowering the ship 293 to reduce the distance between the bottom of the ship and the keel blocks. When the hull position sensor 289 detects that the distance between the bottom and the keel blocks has reduced, for example, to 300 mm, one of the main drain pumps 278 is held out of operation, causing the other main drain pump 278 to drain the dock at a half speed until the bottom of the ship comes into contact with the keel blocks.

In the meantime, the central control unit 291 gives suitable instructions to the docking apparatus 3 to eventually adjust the position of the ship to the desired position of installation while monitoring the outputs from the hull position sensor 289. If the ship is not so adjustable, the operating main drain pump 278 is also stopped to interrupt the draining operation.

The keel block sensor 288 detects the contact of the bottom of the ship with the keel blocks, whereupon the central control unit 291 stores the water level and calculates the water level at which the bilge blocks 283 are to be placed beneath the bottom, based on the data forwarded from the input-output unit 290. At the same time, the main drain pump 278 at rest is initiated into operation again to resume full-speed drainage by the two main pumps 278 while monitoring the output of the water level sensor 281.

When the water level sensor 281 detects that the dock 1 has been drained to the water level where the bilge blocks 283 are to be inserted, the central control unit 291 gives a bilge block insertion instruction signal to the automatic bilge block control unit 287, which in turn automatically place the bilge blocks 283 beneath the bottom of the ship. The sensor 284 then detects that the bilge blocks 283 have been completely inserted in place, whereupon the bilge block control unit 287 delivers an insertion completion signal to the central control unit 291.

Upon receipt of this signal, the central unit 291 recognizes that the ship 293 has been installed completely and feeds an installation completion signal to the apparatus 3 and units 285, 286, 287, 289 and 290, which in turn emit a confirmation signal to the unit 291.

The drain pump control unit 286 further monitors the water level sensor 281 for continued draining operation. In response to instructions from the unit 286 based in outputs from the water level sensor 281, the main drain pumps 278 are changed over to the auxiliary drain pumps 279 and then to the complete drain pump 280, which drains the dock 1 completely.

While the components of the automatic system are automatically controlled as above according to the specified procedure when performing automatic installation, they can be operated individually singly otherwise.

For the foregoing docking operation, the hull suction disk 107 of each docking apparatus 6 is operated by the vacuum pump units 139. The water-enclosed vacuum pump of the unit 139 produces a vacuum by the circulation of water admitted thereto. The water within the pump is forced out from its outlet in the form of water drops along with compressed air owing to internal disturbance of circulating water, so that water must be supplied to the pump at all times during operation. Further in order to prevent the rise of the temperature of water in the pump, there is a need to discharge water from the outlet at a constant rate and replenish the pump with water at the same rate via an inlet. For these purposes, the water in the clean water tank 140 of the docking truck 6 is circulated through the vacuum pump units 139 to always replenish the vaccum pumps with water in the following manner. When the outer plate of the ship 293 is to be attracted to the suction disk 107, the arm 101 is swivelled to press the disk 107 against the outer plate, and the water pump 150 is thereafter initiated into operation, with the electromagnetic valve 153 on the water supply pipe 147 opened at the same time. The water in the tank 140 is sent into the vacuum units 139 via the supply pipe 147. During the flow, the strainer 152 removes foreign matter from the water. The flow switch 154 detects the rate of the flow. When the flow rates reaches a predetermined level, the vacuum pump units 139 are initiated into operation to remove air from between the suction disk 107 and the hull outer plate to establish a vacuum. When the vacuum gauge 160 detects that a specified vacuum is obtained, a hull attraction completion signal is emitted. On the other hand, the water discharged from the outlets of the vacuum pumps is returned to the tank 140 via the return pipe 157 and recycled for reuse. The water supplied to the units 139 not only replenishes the vacuum pumps but serves also to remove the heat of compression and prevent internal leakage of gas and is used for mechanical flushing. The vacuum pump units 139 are provided with two safety devices having the following functions. One of the devices monitors the output of the flow switch 154 during the attraction of the hull (by the vacuum maintained), such that when the flow rate of water supply drops below the predetermined value, the device stops the pump units 139 and, at the same time, closes the electromagnetic valve 153 and stops the pump 150. The valve 153 is closed to prevent the drainage of the units 139 due to a reverse flow of water from the units 139 to the tank 140 which is positioned therebelow owing to a siphon action. It is also required that the water-enclosed vacuum pump to be initiated into operation contain water in about $\frac{1}{2}$ to $\frac{1}{4}$ the specified amount. The other device releases the suction disk 107 from the hull by detecting the amount of strain of the disk when an excessive force acts on the hull attracting disk 107 during docking to exert an excessive force on the swivelling hydraulic cylinder or on the docking truck 6. At the same time, the pump units 139 and the pump 150 are stopped and the valve 153 is closed in response to a disk release signal.

When the docked ship is held attracted to the suction disk 107 of the docking truck 6 connected to the drive truck 4, horizontal forces act on the forward end of the disk arm 101 owing to the wind pressure acting on the ship, the force of the tugboat pushing or towing the ship and the force due to the kinetic energy for stopping the ship in motion. These external forces are divided into a horizontal force which is perpendicular to the truck 6 (perpendicular horizontal force) and a horizontal force parallel to the truck 6 (parallel horizontal force).

Figure 26:
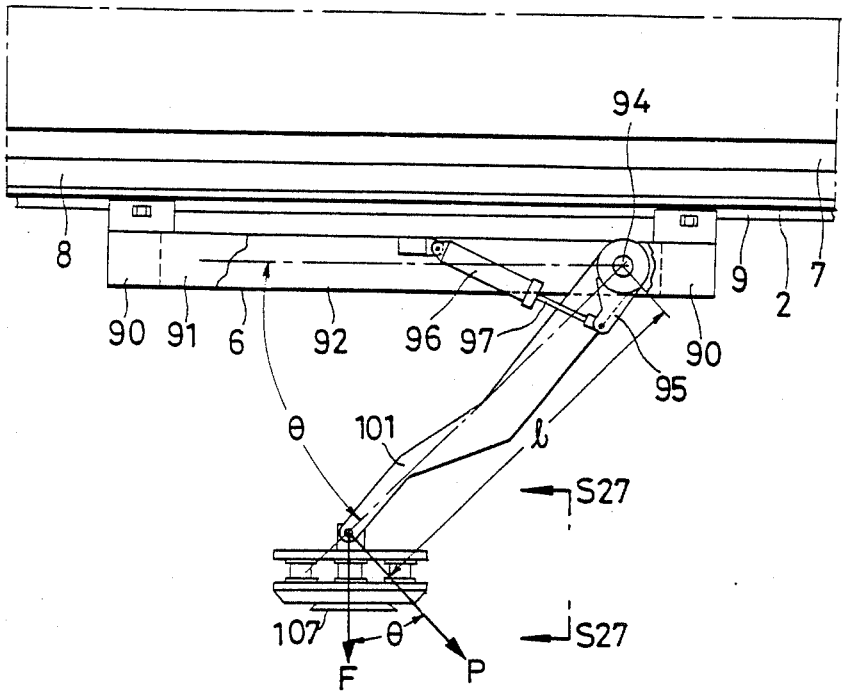
FIG. 26 is a plan view partly broken away of the docking truck to show a hull suction disk as advanced from the docking truck.

Since the center of the horizontal pin 102 at the base end of the disk arm 101 is approximately at the same level as the horizontal wheels 35, 36 on the truck 4, the perpendicular horizontal force due to the ship is chiefly borne by the horizontal wheel rails 27 of the upper track 8 via the swivelling cylinder 96 on the truck 6, the truck 6, the truck 4 and the horizontal wheels 35, 36 of the truck 4. Accordingly if the perpendicular horizontal force is excessively great, there is the likelihood that portions of the trucks 4, 6 will become damaged. To prevent this, there is the need to limit the force to not greater than a permissible value. The maximum value of the perpendicular horizontal force to be exerted on the truck 6, etc. is limited by the maximum value of the torque for swivelling the arm 101, i.e. that of the hydraulic pressure of the swivelling cylinder 96. When this maximum value is definite, the maximum value of the perpendicular horizontal force varies with the angle of swivelling of the arm 101 with respect to the truck 6. With reference to FIG. 26, it is assumed that the length of the arm 101 is l and the torque for swivelling the arm is T. The force P acting on the forward end of the arm 101 perpendicular thereto is $$P = T/l$$

Further when the swivelling angle of the arm 101 is $\theta$, the perpendicular horizontal force F acting on the forward end of the arm 101 is $$F = P \cdot \cos\theta$$
$$= (T/l) \cdot \cos\theta$$

With the hydraulic control system 120 for the truck 6, therefore, the pressure settings for the electromagnetic proportional relief valves 121, 122 for the cylinder 96 are individually controlled according to the swivelling angle of the arm 101 to thereby limit the perpendicular horizontal force to not larger than the definite permissible value. Stated more specifically, the angle sensor 123 of the system 120 detects the swivelling angle of the arm 101 at all times, and the output signal is fed to the arithmetic control unit 124 via the digital input circuit 125. The output signal from the angle sensor 123 is expressed by a reflected binary code and is converted to a pure binary code by the conversion circuit 126. The control unit 124 has a table having stored therein pressure settings individually for the two relief valves 121, 122 at the head side and the rod side of the cylinder 96 at varying swivelling angles of the arm 101 based on the foregoing relation. The pressure settings for the two valves 121, 122 corresponding to the output of the conversion circuit 126, namely, the angle of the arm 101, are individually fed from the table reference circuit 127 to the arithmetic circuit 128. In the table, the pressure settings are stored in terms of 9-bit pure binary codes as voltage values. The two output signals (pressure settings) from the table reference circuit 127 are individually multiplied by 8 and converted to 12-bit pure binary codes in the arithmetic circuit 128, which feeds the outputs to the corresponding analog output circuits 129, 130 individually. The outputs are subjected to digital-analog conversion by the circuits 129, 130, which give analog signals corresponding to the pressure settings to the amplifiers 131, 132. The amplifiers 131, 132 pass currents corresponding to the input signals (voltages) to the corresponding relief valves 121, 122 for the control of the pressure settings thereof. Thus the pressure settings of the two relief valves 121, 122 are individually controlled according to the swivelling angle of the arm 101, with the result that the oil pressures in the two oil chambers 115, 116 of the cylinder 96 do not exceed the pressures to which the valves 121, 122 are set. Even when the angle of the arm 101 varies, accordingly, the perpendicular horizontal force on the arm end is limited to not greater than the predetermined permissible value. When the swivelling angle of the arm 101 is 90°, the swivelling torque of the arm 101 for bearing the rectangular horizontal force is indefinite, so that the use of the hydraulic control system 120 is restricted. The parallel horizontal force acting on the truck 6, etc. is limited to not greater than a permissible value by limiting the running force of the drive units 34 on the drive truck 4.

The ship within the dock 1 is subjected to upward or downward movement, rolling or pitching due to variations of the water level. When such a ship is attracted to the suction disk 107 of the truck 6 connected to the drive truck 4, a vertical force acts on the forward end of the arm 101 which force tends to move the arm vertically. With the docking truck 6 holding the ship attracted to its disk 107, the oil is supplied only to the head oil chamber 133 of the cylinder 103 so as to lift the disk at all times. Furthermore, the oil pressure in the chamber 133 is set by the relief valve 138 to a pressure (lifting pressure) for supporting the arm 101 and disk 107 against the gravity plus a small pressure (additional pressure). Consequently the suction disk 107 moves up and down following the upward or downward or like movement of the hull and will not lift the hull. At this time, the portion of the inclining hydraulic cylinder 103 connected to the swivel post 94 is merely subjected to a small force corresponding to the additional pressure. Accordingly the force acting between the horizontal wheel 93 and the rail 32 of the lower track 9 is small. Further because the center of the horizontal pin 102 at the base end of the arm 101 is approximately at the same level as the horizontal wheels of the drive truck 4, the perpendicular horizontal force due to the ship is borne by the horizontal wheel rail 27 of the upper track 8. Thus, even if a perpendicular horizontal force acts outwardly of the dock, the force acting between the horizontal wheel 93 on the leg 90 of the truck 6 and the rail 32 of the lower track 9 is small. Because of these features it is possible to reduce the number of wheels to be attached to the leg 90 of the truck 6, to use a small wheel therefor and to use a small rail for the lower track 9. The horizontal wheel 93 on the leg 90 is urged in a direction in which it is pressed against the rail 32 of the lower track 9 (outward of the dock), by the falling moment of the truck 6 itself which acts to incline the upper portion thereof inwardly of the dock. It is urged in the same direction by the additional pressure of the cylinder 103 as already stated. Further as described above, the perpendicular horizontal force due to the ship is borne by the horizontal rails 27 of the upper track 8 chiefly via the horizontal wheels 35, 36 of the truck 4, so that even when a perpendicular horizontal force acts outward of the dock, there is little or no force which acts to move the horizontal wheel 93 on the leg 90 away from the lower track rail 32. Thus the wheel 93 is always urged into pressing contact with the rail 32 despite the action of external force on the truck. This eliminates the need to provide on the lower portion of the leg 90 a horizontal wheel or the like for holding the wheel in contact with the lower track 9, consequently making it possible to simplify the leg lower portion and the lower track 9 in construction.

Because the perpendicular horizontal force due to the ship is borne by the horizontal wheel rails 27 of the upper track 8 chiefly by way of the horizontal wheels 35, 36 of the drive truck 4, a considerably great force acts on the mount portions of the wheels 35, 36 on the drive truck 4, and this force is delivered to the truck 4 through the housing 48, liners 61 and stoppers 54, 56. Since these members are in face-to-face contact with each other, the mount portions of the wheels 35, 36 withstand the great force. The housing 48, which has the wheels 35, 36 attached thereto, is attached to the truck 4, so that the parts are easy to assemble with high accuracy.

After the ship has been completely installed in place, the docking truck 6 is separated from the drive truck 4 and stowed on the bases 263, 264 as described, permitting the trucks 4 and 5 only to run. Using surface treating devices for the truck 5, the hull surface is first washed with pressurized water to remove salt and deposits, the corroded portions are blasted and finally the hull surface is coated. Thus, the hull surface is treated by a sequence of operations (see FIG. 1 (*b*)).

When the ship is to be hauled out of the dock thereafter, a procedure reverse to the above is performed.

With use of the present docking apparatus wherein the docking truck 6 is connected to the drive truck 4, ships can be docked without using a towing wire rope, and the operation can be carried out automatically. This assures savings in labor and improved safety. Because the drive truck 4 and the surface treating truck 5 only are driven for surface treating work with the docking truck 6 removed from the truck 4, the truck 5, which is used frequently, can be operated at a reduced cost, hence economical. Further the running drive units 34 are provided on the drive truck 4 only and are not mounted on the truck 5 or 6, hence also economical.

Although the docking trucks 6 are mounted on the both side walls 2 of the dock 1 according to the foregoing embodiment, the trucks 6 may be provided on one side wall 2 only. Furthermore, although two trucks 6 are mounted on each side wall 2, only one truck 6 may be provided on the side wall 2.

What is claimed is:

1. An apparatus for hauling a ship into and out of a dock comprising a drive truck adapted to run along a side wall of the dock approximately horizontally, a surface treating truck connected to the drive truck at all times and having a hull surface treating device, and a docking truck connectable to and separable from the drive truck and having a retractable hull suction disk, the drive truck alone being provided with running drive means.

2. An apparatus as defined in claim 1 wherein the dock side wall is provided with an upper track installed on an approximately horizontal surface at an upper portion of the side wall and extending approximately horizontally along the side wall and with a lower track installed on a lower portion of the side wall and extending approximately in parallel with the upper track, the drive truck being adapted to run on the upper track, the surface treating truck being connected to one end of the drive truck at all times and bridging the space between the upper track and the lower track, the docking truck being connectable to the side of the drive truck inward of the dock to bridge the space between the drive truck and the lower track.

3. A apparatus as defined in claim 2 wherein the running drive means comprises a frame attached to the drive truck so as to be rotatable about an approximately horizontal axis substantially at right angles with the upper track, two vertical drive wheels mounted on the frame as spaced apart from each other by a small distance longitudinally of the upper track and coupled to each other, and two prime movers mounted on the frame and connected to the two vertical drive wheels individually.

4. An apparatus as defined in claim 2 wherein the drive truck and the surface treating truck are connected together end-to-end so as to be rotatable relative to each other about an approximately vertical axis and about an approximately horizontal axis at right angles with the upper track but almost nonrotatable relative to each other about an axis substantially in parallel with the upper track, the drive truck being provided at each of two portions thereof with at least one vertical wheel placed on the upper side of the upper track and with at least two horizontal wheels in contact with opposite sides of the upper track, the surface treating truck having at least one vertical wheel mounted on an upper portion thereof and placed on the upper side of the upper track, at least two upper horizontal wheels mounted on an upper portion thereof and in contact with opposite sides of the upper track and at least one lower horizontal wheel mounted on a lower portion thereof and in contact with the side face of the lower track, the docking truck having at least one horizontal wheel mounted on a lower portion thereof and in contact with the side face of the lower track.

5. An apparatus as defined in claim 4 wherein said at least two horizontal wheels of the drive truck in contact with opposite sides of the upper track are mounted on a horizontal wheel housing, and a plurality of stoppers are attached to the bottom of the drive truck, the housing being secured to the bottom of the drive truck with a liner interposed therebetween, liners being fixedly provided between the housing and the stoppers.

6. An apparatus as defined in claim 1 or 2 wherein the hull suction disk of the docking truck is of the vacuum type, and the docking truck has a vacuum pump for the hull suction disk and is provided in its structure with a clean water tank for the vacuum pump.

7. An apparatus as defined in claim 1 or 2 wherein the docking truck is provided with a swivel post swivellable about an approximately vertical axis by a hydraulic cylinder and a suction disk arm connected to the swivel post and pivotally movable about an approximately horizontal axis, the hull suction disk being connected to the forward end of the arm so as to be optionally tiltable.

8. An apparatus as defined in claim 1 or 2 wherein the docking truck has a connecting plate extending approximately horizontally inward of the dock, and the drive truck has a connecting plate extending approximately horizontally outwardly of the dock for supporting the connecting plate of the docking truck, each of the connecting plates being formed with a connecting bore, the docking truck being provided with a connecting pin upwardly or downwardly movable and insertable through the connecting bores, the connecting plate of the docking truck having a vertically movable lifting pin for raising the docking truck relative to the drive truck by coming into pressing contact with the connecting plate of the drive truck.

9. An apparatus as defined in claim 1 or 2 wherein the dock side wall has stowing bases at lower portions thereof for supporting the docking truck and stowing brackets disposed above the stowing bases and having an approximately vertical connecting bore, and the docking truck has a vertically movable stowing pin insertable into the connecting bore of each of the brackets.

* * * * *